US007692089B2

(12) United States Patent
Nishida

(10) Patent No.: US 7,692,089 B2
(45) Date of Patent: Apr. 6, 2010

(54) ELECTRONIC KEYBOARD INSTRUMENT

(75) Inventor: Kenichi Nishida, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 11/858,843

(22) Filed: Sep. 20, 2007

(65) Prior Publication Data

US 2008/0072747 A1 Mar. 27, 2008

(30) Foreign Application Priority Data

Sep. 21, 2006 (JP) ..... 2006-255314
Aug. 21, 2007 (JP) ..... 2007-214689

(51) Int. Cl.
*G10H 1/32* (2006.01)

(52) U.S. Cl. ..... 84/644; 84/719; 84/744

(58) Field of Classification Search ..... 84/644, 84/718, 719, 743, 744
See application file for complete search history.

(56) References Cited

U.S. PATENT DOCUMENTS 1,893,893 A * 1/1933 Hammond, Jr. ..... 181/141
2,949,053 A * 8/1960 Andersen ..... 84/733
2,952,179 A * 9/1960 Andersen ..... 84/733
3,002,412 A * 10/1961 Andersen ..... 84/702
3,391,241 A * 7/1968 Andersen ..... 84/718
3,643,000 A * 2/1972 Andersen ..... 84/600
4,058,045 A * 11/1977 Jennings et al. ..... 84/731
4,084,473 A * 4/1978 Kitashima et al. ..... 84/731
4,334,453 A * 6/1982 Kumano ..... 84/177
5,086,686 A * 2/1992 Misawa et al. ..... 84/718
5,243,125 A * 9/1993 Yamaguchi ..... 84/745
5,248,846 A * 9/1993 Koike et al. ..... 84/718
5,335,283 A * 8/1994 Torii ..... 381/118
6,528,708 B2 * 3/2003 Konishi et al. ..... 84/177
6,696,633 B2 * 2/2004 Miyagishima et al. ..... 84/737
6,916,980 B2 * 7/2005 Ishida et al. ..... 84/743
6,972,358 B2 * 12/2005 Ishihara et al. ..... 84/177
7,060,890 B2 * 6/2006 Sato et al. ..... 84/745
7,078,611 B2 * 7/2006 Izumi et al. ..... 84/743
7,119,269 B2 * 10/2006 Furuhashi ..... 84/744
7,141,729 B2 * 11/2006 Uno et al. ..... 84/236
7,332,669 B2 * 2/2008 Shadd ..... 84/742
7,348,477 B2 * 3/2008 Ishihara et al. ..... 84/177
7,425,672 B2 * 9/2008 Haba et al. ..... 84/423 R
2001/0052280 A1 * 12/2001 Konishi et al. ..... 84/277
2003/0051594 A1 * 3/2003 Ishihara et al. ..... 84/177
2003/0121402 A1 * 7/2003 Yataka et al. ..... 84/625
2003/0121403 A1 * 7/2003 Miyagishima et al. ..... 84/735

(Continued)

FOREIGN PATENT DOCUMENTS

JP 07-325576 12/1995

(Continued)

*Primary Examiner*—David S. Warren
(74) *Attorney, Agent, or Firm*—Morrison & Foerster LLP

(57) ABSTRACT

An electronic keyboard instrument is assembled on a frame member. A keyboard has a plurality of keys pivotably supported by the frame member. A lower case is formed integrally with or separately from the frame member under the keyboard. An electroacoustic transducer is accommodated in a space between the keyboard and a bottom plate of the lower case, and outputs an acoustic wave. The acoustic wave outputted from the electroacoustic transducer is radiated outwardly through sound passages configured as gaps in the frame member and gaps between the plurality of the keys.

16 Claims, 10 Drawing Sheets

U.S. PATENT DOCUMENTS

2003/0196541 A1* 10/2003 Ishida et al. ..... 84/622
2004/0173086 A1* 9/2004 Sato et al. ..... 84/745
2005/0103181 A1* 5/2005 Ishihara et al. ..... 84/177
2005/0150367 A1* 7/2005 Izumi ..... 84/746
2006/0027070 A1* 2/2006 Ishihara et al. ..... 84/177
2007/0017343 A1* 1/2007 Nishida ..... 84/423 R
2007/0028755 A1* 2/2007 Suzuki ..... 84/746

FOREIGN PATENT DOCUMENTS

JP 2003-015651 1/2003

* cited by examiner

ELECTRONIC KEYBOARD INSTRUMENT

BACKGROUND OF THE INVENTION

1. Technical Field of the Invention

The present invention relates to an electronic keyboard instrument which contains an electroacoustic transducer.

2. Description of the Related Art

The trend now is to shorten a size in a depth direction of an electronic keyboard instrument. However, an electronic circuit substrate unit equipped with a CPU and a semiconductor integrated circuit for performing key-press detection, sound generation, automatic musical performance and key-press guide, a power circuit unit which supplies power to the electronic circuit substrate unit, and an electroacoustic transducer such as a speaker unit which converts an electrical signal into sound, are typically mounted to a rear portion of a conventional keyboard musical instrument, because of their large bulk.

Because a speaker unit occupies a large mounting space, the speaker unit is the major impediment to size reduction and weight reduction of the musical instrument.

Particularly, in the piano-type keyboard instrument provided with a hammer (mass body), because a mass body pivoting mechanism has large bulk, it is more difficult to secure a space.

It is preferable to reduce a size of the speaker unit itself, however it is difficult to extend an output frequency band to a lower frequency range. Also, the speaker unit necessarily has a size of a certain extent, for example, a diameter of 5 cm or more in a circular or an elliptical shape.

There is a conventional electronic keyboard instrument containing a speaker unit, in which the speaker unit is mounted below a keyboard device while a front opening part of the speaker unit is directed downward, so that the sound is spread from a bottom surface of a case of the musical instrument (refer to Patent Reference 1). However, when the electronic keyboard instrument is placed on a desk, the sound is not spread well. To this end, in practical, the speaker unit cannot help being adopted to a cabinet type electronic keyboard instrument which has a sound emitting space below the speaker unit.

Also, there is another conventional electronic keyboard instrument, in which a large opening part is provided on a bottom plate of a case of the electronic keyboard instrument, and a speaker unit is mounted to a lower stand part, so that the sound from the speaker partially passes through a gap of keys of a keyboard device from the opening part, and is spread toward a player (refer to Patent Reference 2). However, because this electronic keyboard instrument is also a cabinet type, it has a large size.

[Patent Reference 1] Japanese Patent Laid-Open Publication No. 2003-15651

[Patent Reference 2] Japanese Patent Laid-Open Publication No. H7-325576

SUMMARY OF THE INVENTION

Therefore, the present invention has been made in view of the above problems, and it is an object of the present invention to provide an electronic keyboard instrument with a reduced size, that contains an electroacoustic transducer.

In accordance with the present invention, the above and other objects can be accomplished by the provision of an electronic keyboard instrument comprising: a frame member; a keyboard which has a plurality of keys pivotably supported by the frame member; a lower case which is formed integrally with or separately from the frame member under the keyboard; and an electroacoustic transducer which is accommodated in a space between the keyboard and a bottom plate of the lower case, and which outputs an acoustic wave, wherein the acoustic wave outputted from the electroacoustic transducer is radiated outwardly through sound passages configured as gaps in the frame member and gaps between the plurality of the keys.

Accordingly, it is unnecessary to dispose the electroacoustic transducer at the rear portion of the keyboard or to mount an additional case for accommodating the electroacoustic transducer below the lower case, hence the external shape of the electronic keyboard instrument can be made small. Also, because the acoustic wave is radiated from the gaps of the keys, a player can feel the natural musical sound. The present invention is not restricted to a cabinet type or a console type equipped with legs, but can also be applied to a desk type electronic keyboard instrument.

In another aspect, the inventive electronic keyboard instrument comprises: a frame member which has a plurality of mass supporting parts; a keyboard which has a plurality of keys pivotably supported by the frame member and a plurality of force transmission parts mounted to the respective keys; a plurality of mass bodies which are respectively disposed below corresponding ones of the keys and which are pivotably supported by corresponding ones of the mass supporting parts, so that the mass bodies pivot by the force transmission parts mounted to the corresponding keys; a lower case which is formed integrally with or separately from the frame member under the plurality of the mass bodies; and an electroacoustic transducer which is accommodated in a space between the mass bodies and a bottom plate of the lower case, and which outputs an acoustic wave, wherein the acoustic wave outputted from the electroacoustic transducer is radiated outwardly through sound passages configured as gaps between the plurality of the mass bodies and gaps in the frame member.

Accordingly, it is unnecessary to mount the electroacoustic transducer at the rear portion of the keyboard or to mount an additional case for accommodating the electroacoustic transducer below the lower case, hence the external shape of the electronic keyboard instrument can be made small. The present invention can also be applied to a desk type electronic keyboard instrument.

Though the mass bodies are disposed below a plurality of keys, the shape and size of the mass bodies can be designed more freely than the key body parts. Therefore, gaps large enough for the sound passages can be provided between the adjacent mass bodies.

Also, if an acoustic wave outputted from the electroacoustic transducer and passing through the gaps of a plurality of mass bodies and the gaps of the frame member is set to be radiated outwardly through the gaps of a plurality of keys, because the acoustic wave is radiated from the gaps of the keys, a player can feel the natural musical sound.

Preferably in the electronic keyboard instrument, the plurality of the mass bodies have pivot point parts which are supported by the corresponding mass supporting parts, operation parts which contact to the force transmission parts of the corresponding keys at positions forward of the pivot point parts, and inertia generating parts which generate a moment of inertia at positions rearward of the pivot point parts. The mass supporting parts are mounted such that the pivot point part of each mass body is positioned higher than a lowermost descending position of the inertia generating part when the inertia generating part of each mass body pivots to a lower limit position. The electroacoustic transducer is accommodated in the space below the inertia generating parts of the mass bodies such that an uppermost portion of the electroacoustic transducer is positioned higher than the lowermost descending position of each inertia generating part.

Accordingly, though the electroacoustic transducer is accommodated inside the case of the electronic keyboard instrument which is provided with the mass bodies, the position of the uppermost portion of the electroacoustic transducer can be heightened to a space above the lowermost descending position of the inertia generating part, hence the total height of the electronic keyboard instrument can be restricted to be low.

Preferably, the electronic keyboard instrument described above further comprises further comprising an upper case which is coupled to the lower case and covers a rear portion of the keyboard, wherein the upper case is provided with one or more sound emitting holes on at least a rear portion of the upper case, such that the acoustic wave outputted from the electroacoustic transducer is radiated outwardly through sound passages configured as the sound emitting holes of the upper case.

Because the upper case has a surface area large enough to form a plurality of small sound emitting holes or to form one large sound emitting hole, sound passages through which an acoustic wave can smoothly pass can be easily formed.

Specifically, if the sound emitting holes are provided at an area opposing the rear portion of the inertia generating part of the mass body, in the pivot range between the upper limit position (the position of an upper limit stopper) of the inertia generating part and the lower limit position (the position of a lower limit stopper) of the inertia generating part, the length of the sound passage extending from the electroacoustic transducer to the sound emitting holes can be shortened.

Preferably in the electronic keyboard instrument described above, wherein the lower case and/or the frame member are provided with one or more sound emitting holes on front lower portions thereof, so that the acoustic wave outputted from the electroacoustic transducer is radiated outwardly through sound passages configured as the sound emitting holes.

Because the lower case and/or the frame member have a surface area large enough to form a plurality of small sound emitting holes or to form one large sound emitting hole, sound passages through which an acoustic wave can smoothly pass can be easily formed.

Preferably in the electronic keyboard instrument described above, the lower case is provided with a pedestal part and a concave part at a bottom surface portion of the lower case, the concave part is formed downward from the bottom surface portion of the lower case, and accommodates a portion of the electroacoustic transducer, and the sound emitting holes are provided on at least a front portion of the concave part of the lower case.

Accordingly, because a player can receive a feeling as if an acoustic wave is outputted from the key itself, i.e., an object on which the player applies a pressing force by a finger, non-realistic feeling peculiar to an electronic musical instrument is decreased, and a keyboard instrument having realistic feeling can be achieved.

Preferably in the electronic keyboard instrument described above, the electroacoustic transducer is accommodated in the space such that a central axis of a front opening part of the electroacoustic transducer is inclined rearward from a vertically up direction of the keyboard. Accordingly, an acoustic wave is easily radiated to a range centering around a rear upper portion of the upper case.

In another aspect of the invention, the inventive electronic keyboard instrument comprises: a frame member; a keyboard which has a plurality of keys pivotably supported by the frame member; a lower case which is formed integrally with or separately from the frame member under the keyboard; and an electroacoustic transducer which outputs an acoustic wave, and which is accommodated in a space between the keyboard and the lower case such that a central axis of a front opening part of the electroacoustic transducer is inclined forward from a vertically down direction of the keyboard, wherein the lower case and/or the frame member are provided with one or more sound emitting holes on front lower portions thereof, so that the acoustic wave outputted from the electroacoustic transducer is radiated outwardly through sound passages configured as the sound emitting holes.

Accordingly, it is unnecessary to dispose the electroacoustic transducer at the rear portion of the keyboard or to mount an additional case for accommodating the electroacoustic transducer below the lower case, hence the external shape of the electronic keyboard instrument can be made small, and the present invention can be applied to a desk type electronic keyboard instrument.

The electroacoustic transducer is accommodated such that the central axis of the front opening part of the electroacoustic transducer is inclined forward from the vertically down direction of the keyboard, hence the acoustic wave is easily radiated to a zone around a front portion of the lower case.

If the central axis of the front opening part of the electroacoustic transducer is oriented to the vertically down direction of the keyboard, the acoustic wave is hardly outputted in case that the electronic keyboard instrument is placed on a desk. According to the invention, the lower case and/or the frame member have a surface area large enough to form a plurality of small sound emitting holes or to form one large sound emitting hole, hence sound passages through which an acoustic wave can smoothly pass can be easily formed.

Also, if an acoustic wave outputted from a rear opening of the electroacoustic transducer is set to be radiated outwardly through the gaps of the frame member and the gaps of the plurality of keys, because the acoustic wave is radiated from the gaps of the keys, a player can feel the natural musical sound.

In another aspect of the invention, the inventive electronic keyboard instrument comprises: a frame member which has a plurality of mass supporting parts; a keyboard which has a plurality of keys pivotably supported by the frame member and a plurality of force transmission parts mounted to the respective keys; a plurality of mass bodies which are respectively disposed below corresponding ones of the keys and which are pivotably supported by corresponding ones of the mass supporting parts, so that the mass bodies pivot by the force transmission parts mounted to the corresponding keys; a lower case which is formed integrally with or separately from the frame member under the plurality of the mass bodies; and an electroacoustic transducer which outputs an acoustic wave, and which is accommodated in a space between the mass bodies and the lower case such that a central axis of a front opening part of the electroacoustic transducer is inclined forward from a vertically down direction of the keyboard, wherein the lower case and/or the frame member are provided with one or more sound emitting holes on front lower portions thereof, so that the acoustic wave outputted from the electroacoustic transducer is radiated outwardly through sound passages configured as the sound emitting holes.

Accordingly, it is unnecessary to dispose the electroacoustic transducer at the rear portion of the keyboard or to mount an additional case for accommodating the electroacoustic transducer below the lower case, hence the external shape of the electronic keyboard instrument can be made small, and the present invention can be applied to a desk type electronic keyboard instrument.

The electroacoustic transducer is accommodated such that the central axis of the front opening part of the electroacoustic transducer is inclined forward from the vertically down direction of the keyboard, hence the acoustic wave is easily radiated to a zone around a front portion of the lower case.

If the central axis of the front opening part of the electroacoustic transducer is oriented to the vertically down direction of the keyboard, the acoustic wave is hardly outputted in case that the electronic keyboard instrument is placed on a desk. According to the invention, the lower case and/or the frame member have a surface area large enough to form a plurality of small sound emitting holes or to form one large sound emitting hole, hence sound passages through which an acoustic wave can smoothly pass can be easily formed.

Also, if an acoustic wave outputted from a rear opening of the electroacoustic transducer is set to be radiated outwardly through the gaps of the plurality of the mass bodies and the gaps of the frame member, because the acoustic wave is radiated from the gaps of the keys, a player can feel the natural musical sound.

Preferably, the plurality of the mass bodies have pivot point parts which are supported by the corresponding mass supporting parts, operation parts which contact to the force transmission parts of the corresponding keys at positions forward of the pivot point parts, and inertia generating parts which generate a moment of inertia at positions rearward of the pivot point parts. The mass supporting parts are mounted such that the pivot point part of each mass body is positioned higher than a lowermost descending position of the inertia generating part when the inertia generating part of each mass body pivots to a lower limit position. The electroacoustic transducer is accommodated in the space below the inertia generating parts of the mass bodies such that an uppermost portion of the electroacoustic transducer is positioned higher than the lowermost descending position of each inertia generating part.

Accordingly, though the electroacoustic transducer is accommodated inside the case of the electronic keyboard instrument which is provided with the mass bodies, the position of the uppermost portion of the electroacoustic transducer can be heightened to a space above the lowermost descending position of the inertia generating part, hence the total height of the electronic keyboard instrument can be restricted to be low.

Preferably in the electronic keyboard instrument, the lower case is provided with a pedestal part and a concave part at a bottom surface portion of the lower case. The concave part is formed downward from the bottom surface portion of the lower case, and accommodates a portion of the electroacoustic transducer. The sound emitting holes are provided on at least a front portion of the concave part of the lower case.

Accordingly, because a player can receive a feeling as if an acoustic wave is outputted from the key itself, i.e., an object on which the player applies a pressing force by a finger, non-realistic feeling peculiar to an electronic musical instrument is decreased, and a keyboard instrument having realistic feeling can be achieved.

Preferably in the electronic keyboard instrument, the lower case is divided into a first region and a second region along a width direction of the keyboard which is perpendicular to a depth direction of the keyboard, so that the electroacoustic transducer is not disposed in the first region but disposed in the second region. The bottom surface portion of the lower case is shaped in a flat face in the first region, and shaped in a slant face in the second region such that the slant face is inclined forward and positioned higher than the flat face. The electroacoustic transducer is mounted on the slant face made of a bottom plate of the lower case. A plurality of pedestals are provided on the lower case and at least one of the pedestals is provided under the flat face of the bottom surface portion of the lower case in the first region. The sound emitting holes are provided on the slant face of the bottom surface portion of the lower case.

Accordingly, because a player can receive a feeling as if an acoustic wave is outputted from the key itself, i.e., an object on which the player applies a pressing force by a finger, non-realistic feeling peculiar to an electronic musical instrument is decreased, and a keyboard instrument having realistic feeling can be achieved.

Preferably in the electronic keyboard instrument according to the invention, the frame member is formed with an upper section which extends along a width direction of the key board which is perpendicular to a depth direction of the keyboard, and partition ribs which extend downward from the upper section into the space between the lower case and the keyboard for reinforcing the frame member, and which are disposed between groups of white keys of the keyboard. The electroacoustic transducer is disposed between adjacent ones of the partition ribs within the space.

Accordingly, the electroacoustic transducer is arranged in an area free of the partition ribs. Even when the partition ribs extend downward lengthily, the partition rib is never an obstacle for arranging the electroacoustic transducer. The size of the electroacoustic transducer in the width direction of the keyboard may be made comparable to the interval between the pair of adjacent partition ribs, whereby the electroacoustic transducer having the maximum opening diameter can be accommodated.

In case that the electronic keyboard instrument has mass bodies, the plurality of the partition ribs extend downward from the upper portion of the frame member and pass through gaps of the plurality of the mass bodies.

Preferably, the electronic keyboard instrument further comprises an electric circuit part which is disposed in the space in alignment with the electroacoustic transducer along a width direction of the keyboard which is perpendicular to a depth direction of the keyboard for driving the electroacoustic transducer.

The electric circuit part necessary for driving the electroacoustic transducer can be efficiently accommodated in a space between the keyboard and the bottom plate of the lower case in case that the mass bodies are not used or in a space between the mass bodies and the bottom plate of the lower case in case that the mass bodies are used, whereby the outer size of the electronic keyboard instrument can be made compact.

As apparent from the above-described constitution, the electronic keyboard instrument according to the present invention can be manufactured to be small in shape, while containing an electroacoustic transducer.

DETAILED DESCRIPTION OF THE INVENTION

Figure 1:
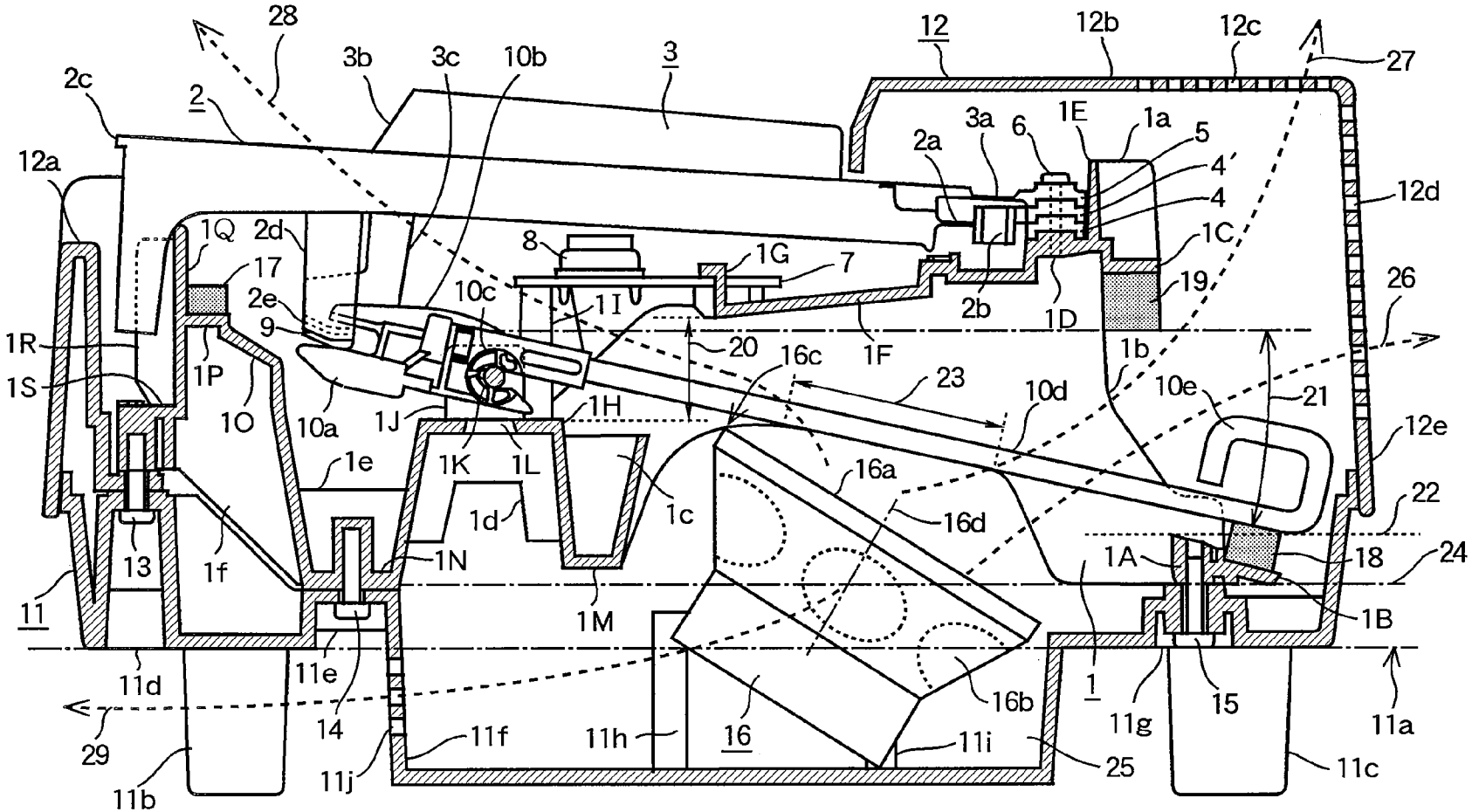
FIG. 1 is an explanation view illustrating a first embodiment of the present invention, and a schematic sectional view when seeing an electronic keyboard instrument from the right side.

FIG. 1 is an explanation view illustrating a first embodiment of the present invention, and a schematic sectional view when seeing an electronic keyboard instrument from the right side. In order to show coupling relations between respective components, the respective parts are sectioned on different planes.

Hereinafter, in a longitudinal direction of a key, a depth direction will be referred to as a "rear direction", and a direction directed to a front end of the key will be referred to as a "front direction". A direction in which the keys are arranged parallel in the keyboard will be referred to as a "key arranging direction" or simply "width direction".

The keyboard is provided with a plurality of keys composed of key body parts (white keys) 2 and key body parts (black keys) 3, which are partially illustrated in the drawing. Each of the keys is pivotably supported by a keyboard frame (supporting member or frame member) 1.

The keyboard frame 1 is unitarily made of resin, however it may partially include a metal member.

The keyboard frame 1 is largely sectioned into rear lower parts 1A and 1B which are located at a rear lower portion, upper parts 1C to 1G which are located over an upper area from a middle portion in the longitudinal direction to a rear portion, and front lower parts 1H to 1S which are located at a front lower portion. The respective parts extend in the key arranging direction.

These flat plate-shaped members are reinforced by a plurality of partition ribs 1*a* to 1*f*. The ribs 1*a* to 1*f* have a thin flat plate shape, and extend in the longitudinal direction of the key and in the up/down direction.

Of them, the rib 1*b* is also used to couple the rear lower parts, the upper parts, and the front lower parts. The rib 1*b* is mounted in each of the gaps formed between a plurality of mass bodies 10 which are in parallel with each other in the key arranging direction. In an example which will be described later with reference to FIG. 3, the rib 1*b* is mounted in each of gaps formed between the adjacent white keys. Therefore, the partition rib 1*b* extends downward from the upper part of the support member which extends in the width direction of the keyboard (namely, arranging direction of the keys perpendicular to the depth direction of the keyboard) and passes through gaps between the plurality of the mass bodies 10. The other ribs do not have a limitation in mounting positions in the key arranging direction, however they are typically mounted on the extension of the rib 1*b*.

The key body parts (white keys) 2 and the key body parts (black keys) 3 are covered by an upper case 12, except for key manipulating portions which are exposed outside. A reference numeral 12*a* refers to a clapper part. A portion of the upper case 12 and a portion of the lower case 11 are fitted into the clapper part, and are coupled to the keyboard frame 1. It is illustrated in the drawing that the keyboard frame 1 is provided separately from the lower case 11, however the keyboard frame 1 may be integrally formed with the lower case 11.

The lower case 11 is provided with pedestal parts 11*b* and 11*c* at the bottom surface portion 11*a* of the lower case 11, which forms a base part of the lower case 11. Legs can be affixed to the pedestal parts 11*b* and 11*c*, or the bottom surface portion 11*a* of the lower case 11 can be loaded on a frame stand having legs.

The musical instrument may be a cabinet type by affixing the legs to the lower surface portion 11*a* of the lower case 11. In this case, the lower case 11 is called a shelf plate.

In this embodiment, in order to give key touch feeling like a piano, the mass bodies 10, i.e., the hammers are provided.

A force transmission part 2*d* is protruded from a lower portion of the key body part (white key) 2. The force transmission part 2*d* is provided with a bottom plate 2*e* at its front end, and a through-hole is formed above the bottom plate 2*e* in the longitudinal direction of the key. Felts 9 are attached to an upper surface and a lower surface of the bottom plate 2*e*.

The mass bodies 10 are mounted to the respective keys, and are arranged in the key arranging direction. The drawing shows the mass body 10 for the key body part (white key) 2. The mass body 10 is pivotably supported on the keyboard frame 1 by a mass body pivot supporting part (or simply, mass supporting part) 1J which is formed at the keyboard frame 1. The mass body pivot supporting part 1J may be separately formed and mounted to the keyboard frame 1.

The mass body 10 includes a pivot point part 10*c* which is supported by the corresponding mass body pivot supporting part 1J, a main driven part 10*a* and a sub driven part 10*b* (collectively operation part) which contacts with and couples to the force transmission part 2*d* of the key at positions forward of the pivot point part 10*c*, and a inertia generating part 10*d* which has an arm shape and generates the moment of inertia at positions rearward of the pivot point part 10*c*. A rear end of the inertia generating part 10*d* is configured as a mass concentration part 10*e*.

The main driven part 10*a* and the sub driven part 10*b* are coupled to the force transmission part 2*d* by inserting the bottom plate 2*e* covered with the felts 9 between the driven parts 10*a* and 10*b*.

If the mass body 10 pivots correspondingly to the player's manipulation of pressing the key, reaction due to the moment of inertia of the inertia generating part 10*d* is applied to the player's finger from the key body part (white key) 2. If the player separates the finger from the key, the mass body 10 pivots reversely by the action of the gravity and returns to the position shown in the drawing.

The mass body pivot supporting part 1J is mounted such that the pivot point part 10*c* is positioned higher than a lowermost descending position 22 of the inertia generating part 10*d* when the inertia generating part 10*d* pivots to a lower limit position (position shown in the drawing).

A rear surface of the force transmission part 2*d* of the key body part (white key) 2 is almost aligned with a front surface of a front end portion 3*b* of the black key body part 3 in the longitudinal direction of the key. A force transmission part 3*c* of the key body part (black key) 3 protrudes downward such that the front surface of the front end portion 3*b* extends to become a front surface of the force transmission part 3*c*, is bent in the front direction on the way, and protrudes again downward. The force transmission part 3*c* of the black key has a bottom plate and felts at the position overlapped with the bottom plate 2*e* of the white key.

Similarly to the white key, the key body part (black key) 3 is provided with a mass body which is pivotably supported by a mass body pivot supporting part and pivots by the corresponding force transmission part 3*c* of the black key.

A reference numeral 16 refers to a speaker unit (electroacoustic transducer). The speaker unit is accommodated in the lower case 11 below the keyboard, beyond a pivot range 21 of the inertia generating part 10*d* in the space between a plurality of mass bodies 10 mounted correspondingly to the respective keys and a bottom plate of the lower case 11. The speaker unit is mounted to speaker supporting parts 11*h* and 11*i* which are protrudingly formed on a bottom surface of a concave part 25 of the lower case 11 by screw coupling, engagement, etc.

Hereinafter, the arrangement of the speaker unit 16 will be described in detail.

The lower limit position (state shown in the drawing) of the pivot of the inertia generating part 10*d* is slanted in the rear and down directions. The speaker unit 16 is accommodated in the space below the inertia generating part 10*d*, such that an uppermost portion 16*c* of the speaker unit 16 (namely, the upper end of the front opening 12*a*) is positioned higher than the lowermost descending position 22 of the inertia generating part 10*d*.

In also this case, the pivot of the inertia generating part 10*d* is not hindered. As a result, although the speaker unit 16 having a large diameter is contained, the height of the electronic keyboard instrument can be restricted.

However, when the rib 1*b* is provided, the height of the upper end 16*c* of the speaker unit 16 is also limited by a lower edge of the rib 1*b*.

To this end, the lower surface of the inertia generating part 10*d* when the inertia generating part 10*d* pivots to the lower limit position (state shown in the drawing), is aligned with a portion 23 of the lower edge of the rib 1*b*. The lower edge of the rib 1*b* is formed in a curved shape (upwardly convex shape) over the front region of the portion 23 of the lower edge of the rib 1*b*.

As a result, the upper end 16*c* of the speaker unit 16 can be disposed closely to the lower limit position of the pivot of the inertia generating part 10*d*. And, the space below the lower limit position of the pivot of the inertia generating part 10*d* can be used to the maximum to arrange the speaker unit 16.

Because the speaker unit 16 is accommodated such that a central axis 16*d* of a front opening part 16*a* (which represents a direction of the front opening part 16*a*) is inclined rearward from the vertically up direction, it is adequate to radiate an acoustic wave from the rear portion and the rear upper portion of the upper case 12.

In this case, even when the inertia generating part 10*d* and the mass concentration part 10*e* are formed as ferromagnetic bodies, such as steel, because a magnet part of the speaker unit 16 is disposed at a lower portion, an influence of the magnetic force on the ferromagnetic bodies is small.

Meanwhile, the above constitution can be modified such that the central axis 16*d* of the front opening part 16*a* of the speaker unit 16 is inclined forward from the vertically down direction, and the acoustic wave from the front opening part 16*a* is radiated from the front portion of the lower case 11. In also this case, the upper end 16*c* of the speaker unit 16 can be disposed closely to the lower limit position of the pivot of the inertia generating part 10*d*.

The speaker unit 16 is generally configured as a cone type speaker which is formed in a circular or an elliptical shape having a diameter of 5 to 12 cm. When seen in the key arranging direction, a pair of left and right speaker units 16 are provided, for example.

There exists a free area in which the speaker unit 16 is not disposed within the space between lowermost pivot limiting position of the inertia generating part 10*d* of each mass body and the bottom plate of the lower case 11. In such a free area, en electric circuit and a battery case (not shown) are accommodated in alignment with the speaker units 16 along the key arranging direction on the bottom plate of the concave part 25 in case that the concave part 25 extends in the arranging direction of the keys, or on the bottom plate of the bottom surface portion 11*a* (in case that the concave part 25 is formed only in a limited area along the key arranging direction for receiving the speaker unit 16). The electric circuit part contains a musical sound processing electric circuit part for driving the speaker unit 16 (e.g., an electronic circuit substrate which is equipped with a musical sound signal generating part and a control CPU, and an amplifier) and a jack circuit part providing external connector terminals.

As the position of the mass body pivot supporting part 1J becomes higher than a lower end 24 of the keyboard frame 1, the space below the inertia generating part 10*d* when the inertia generating part 10*d* pivots to the lower limit position and above the lowermost descending position 22, can be increased.

In order to accommodate a part of the speaker unit 16, a bottom surface portion 11*a* of the lower case 11 is formed with the concave part 25 which extends downward, partially in the key arranging direction. The concave part 25 may be extended in the longitudinal direction of the key, or may be formed in only the left and right positions which are sectioned to respectively accommodate the left and right speaker units 16.

Without modifying the existing keyboard frame 1 and the upper case 12, the speaker unit 16 having the large diameter can be accommodated only by replacing the existing lower case by the lower case 11 formed with the concave part 25.

Because a bottom of the concave part 25 is located higher than lower ends of the pedestal parts 11*b* and 11*c*, the concave part 25 does not increase the height of the electronic keyboard instrument. Therefore, the lower case 11 can be stably put on a desk or the like, and the acoustic wave from the speaker unit 16 is not directly transmitted to the desk or the like through the bottom of the concave part 25.

When a player plays the keyboard or musical data are reproduced in the automatic musical performance mode, the musical sound signal from the speaker unit 16 is converted into the acoustic wave, and is outputted.

Since the speaker unit 16 is accommodated in the lower portion of the lower case 11, the speaker unit 16 can spread the sound fundamentally in all directions.

First sound passages 26 and 27 are defined from the front opening part 16*a* of the speaker unit 16 to the outside, via the gaps of a plurality of mass bodies 10 (the inertia generating parts 10*d* and the mass concentration parts 10*e*) which are in parallel in the key arranging direction, the gaps of the keyboard frame 1, a plurality of sound emitting holes 12*d* formed at a rear surface portion 12*e* of the upper case 12, and a plurality of sound emitting holes 12*c* formed at a rear upper surface portion 12*b* of the upper case 12.

A second sound passage 28 is defined from the front opening part 16*a* of the speaker unit 16 to the outside, via the gaps of a plurality of mass bodies 10 (the inertia generating parts 10*d*, the mass body pivot point parts 10*c*, the main driven parts 10*a*, and the sub driven parts 10*b*), the gaps of the keyboard frame 1, and the gaps of a plurality of keys including the key body parts (white keys) 2 and the key body parts (black keys) 3.

The speaker unit 16 is typically provided with a plurality of rear opening parts 16*b*, as shown by a dotted line in the drawing. The acoustic wave is radiated to the outside through a third sound passage 29 which is defined from the rear opening parts 16*b* to a plurality of sound emitting holes 11*j* formed at a front surface portion 11*f* of the lower case 11.

At this time, the acoustic wave having a phase reverse to the acoustic wave outputted from the front opening part 16*a* is radiated, and it can create the spread of the musical sound.

A similar shape as applied to the front surface portion 11*f* having the sound emitting holes 11*j* may be applied to a part of the keyboard frame 1 rather than the lower case 11. Stated otherwise, the sound emitting holes 11*j* may be formed in the keyboard frame 1 in case that the keyboard frame 1 and the lower case 11 are formed integrally with each other.

The aforesaid sound emitting holes 12*c*, 12*d* and 11*j* are formed as, for example, slits which extend in the transverse direction. Also, the sound emitting holes may be formed as slits which extend in the vertical direction, or may be formed as a plurality of small circular holes. Or, the upper case 12 and the lower case 11 may be provided with large opening parts (sound emitting holes), and punching metals or speaker nets may be attached to the opening parts.

Because each of the mass bodies 10 has a short width (in the key arranging direction), between the mass bodies 10 adjacent to each other are provided the gaps large enough for the acoustic wave to pass.

Because the keyboard frame 1 has a complicated structure and the main components extend in the key arranging direction, the keyboard frame 1 is necessarily structured to have the gaps large enough not to hinder the progress of the acoustic wave.

As the structure of the keyboard frame 1 adequate to radiate the acoustic wave to the outside through the gaps of a plurality of keys, it is illustrated in the drawing that the keyboard frame 1 includes the upper parts 1C to 1G to which the rear ends of a plurality of keys are fixed, and the front lower parts 1H to 1S in which the mass body pivot supporting part 1L is disposed below the upper parts with a gap part 20. Accordingly, the sound passage is secured due to the gap part 20.

Hereinafter, the detailed structure of the electronic keyboard instrument will be described with an emphasis on the structure of the keyboard frame 1.

The keyboard frame 1 is provided with a rear coupling part 1A at the rear lower portion. The rear coupling part 1A of the keyboard frame 1 is fixedly joined with a rear coupling part 11*g* of the lower case 11 by a setscrew 15. A lower limit stopper holding part 1B is provided at the rear of the rear coupling part 1A of the keyboard frame 1. A lower limit stopper 18 of the mass body 10, which is configured as a shock-absorbing member, such as a felt, having a belt shape and extending in the key arranging direction, is attached onto the lower limit stopper holding part 1B.

The keyboard frame 1 is provided with an upper limit stopper holding part 1C at the rear upper portion, onto which an upper limit stopper 19 of the mass body 10 is attached. The material of the upper limit stopper 19 is the same as that of the lower limit stopper 18.

A key installing vertical wall 1E is provided at the front of the upper limit stopper holding part 1C, and a key installing part 1D is provided at the front of the key installing vertical wall 1E. The rear reinforcing rib 1*a* is mounted between the upper limit stopper holding part 1C and the key installing vertical wall 1E.

In the keyboard, for example, the keys of one octave are composed of a black key unit including a plurality of black keys, and two white key units in which the white keys are arranged in a comb teeth shape while being separated from each other by an interval of at least one key. The rear end portions of the respective keys are coupled to a common base part and integrally formed by resin.

The key body part (white key) 2 is connected to a common base part 4 by key supporting parts (a horizontal hinge part 2*a* and a left/right hinge part 2*b*) which are provided at the rear end of the key body part 2. The key body part (black key) 3 is connected to a common base part 5 by a key supporting part (only a horizontal hinge part 3*a*) which is provided at the rear end of the key body part 3. A reference numeral 4' refers to a common base part of the second white key unit.

Three common base parts 4, 4' and 5 are disposed on the key installing part 1D such that their respective concave portions and convex portions are stacked up on each other, and are fixedly joined with the key installing part 1D by a setscrew 6.

A slanted surface part 1F is extended forward from the key installing part 1D while being slanted gently from the horizontal surface. A switch substrate installing part 1G having a latching hook shape is protrudingly formed at a front end of the slanted surface part 1F.

The front lower part is formed at a distance from the front end of the slanted surface part 1F by the gap part 20. The component of the front lower part, which is positioned closest to the switch substrate installing part 1G is a mass body installing pedestal 1H. The switch substrate installing part 1G is connected to the mass body installing pedestal 1H by the rib 1*b*. A boss-shaped switch substrate installing part 1I is protrudingly formed at a rear end of the mass body installing pedestal 1H.

A switch substrate 7 is installed to the keyboard frame 1 by the switch substrate installing parts 1G and 1I. A flexible dome-shaped key switch (on/off sensor) 8 is mounted on the switch substrate 7. The key switch is provided with two switch circuits.

According to the manipulation of pressing the key body part 2, two actuators (not shown) disposed below the key body part 2 press the key switch 8 in order to operate two switch circuits with a time interval. The musical sound signal having a pitch corresponding to the operated key switch 8 is generated by a musical sound signal generating part of an electronic circuit unit (not shown), with a strength according to the operational time interval of two switch circuits, and is outputted from the speaker unit 16 as the acoustic wave form.

A pair of left and right mass body pivot supporting parts 1J, corresponding to each of the keys, are uprightly mounted on the mass body installing pedestal 1H. A right-half portion and a left-half portion of a pivot shaft 1K are mounted to the left and right mass body pivot supporting parts 1J, respectively. The drawing shows only the left mass body pivot supporting part 1J and the left-half portion of the pivot shaft 1K. An opening part 1L provided at the mass body installing pedestal 1H is for inserting a mold for forming the pivot shaft 1K therethrough from below.

A rear portion of the pivot point part 10*c* is partially cut, through which the pivot shaft 1K is inserted.

The above-described main driven part 10*a* and sub driven part 10*b* are integrally formed with the pivot point part 10*c* at the front of the pivot point part 10*c*.

A bar-shaped member, i.e., the inertia generating part 10*d* is extended rearward from the pivot point part 10*c*. The inertia generating part 10*d* is configured as, for example, a bar-shaped metal member which is united to the pivot point part

10*c* made of resin. The rear end of the inertia generating part 10*d* is bent to form the mass concentration part 10*e*.

In the non-key pressing state, the inertia generating part 10*d* descends to the lowermost position to be slanted, and is restricted in position by the lower limit stopper 18. In the key pressing state, by interlocking with the key pressing, the inertia generating part 10*d* pivots left to ascend, and the arm portion at the front of the mass concentration part 10*e* comes into contact with the upper limit stopper 19 to be restricted in position.

The mass body pivot supporting part for the black key, which is not shown, is mounted on the mass body installing pedestal 1H, at a position moved slightly rearward from the mass body pivot supporting part 1J for the white key. The mass concentration part of the mass body for the black key is located at the substantially same position as the mass concentration part 10*e*.

A front coupling part 1N having an inclination is provided at the front of the mass body installing pedestal 1H. A boss portion formed at the front coupling part 1N contacts an intermediate coupling part 11*e* of the lower case 11, and fixed together by a setscrew 14.

The rib 1*d* is mounted at a region defined by a lower surface of the mass body installing pedestal 1H and slanted portions formed at the front and rear of the lower surface. A middle installing part 1M is provided at the rear of the rear slanted portion. The constitutional components (not shown) can be installed on the middle installing part 1M, or can be installed on the lower case 11 by the middle installing part 1M. The rib 1*c* is mounted to the middle installing part 1M.

The keyboard frame 1 is provided with an upward steep slanted part which extends from the front coupling part 1N, which is referred to as a slide surface part 10. The rib 1*e* is mounted between the front coupling part 1N and the slanted portions formed at the front and rear of the front coupling part 1N.

A lower limit stopper holding part 1P for the white key is provided at the front of the slide surface part 10, on which a lower limit stopper 17 is attached. The material of the lower limit stopper 17 is the same as that of the lower limit stopper 18.

The lower limit stopper holding part 1P is connected to a key guide supporting part 1Q which extends vertically. A plate-shaped key guide 1R, which has a thick thickness in the key arranging direction, is coupled to the key guide supporting part 1Q. The key guide 1R is arranged correspondingly to each of a plurality of white keys. The key guide is not mounted to the black key.

Inner walls of the key, which are positioned near a front end portion 2*c* of the key body part 2, are protruded from left and right side surfaces of the key to form a slit. The key guide 1R is inserted into the slit, so that the key body part 2 is restricted in position in the left/right direction.

A front coupling part 1S is mounted beneath the key guide 1R. The front coupling part 1S contacts a front coupling part 11*d* of the lower case 11, and is fixed together by a setscrew 13.

Figure 2:
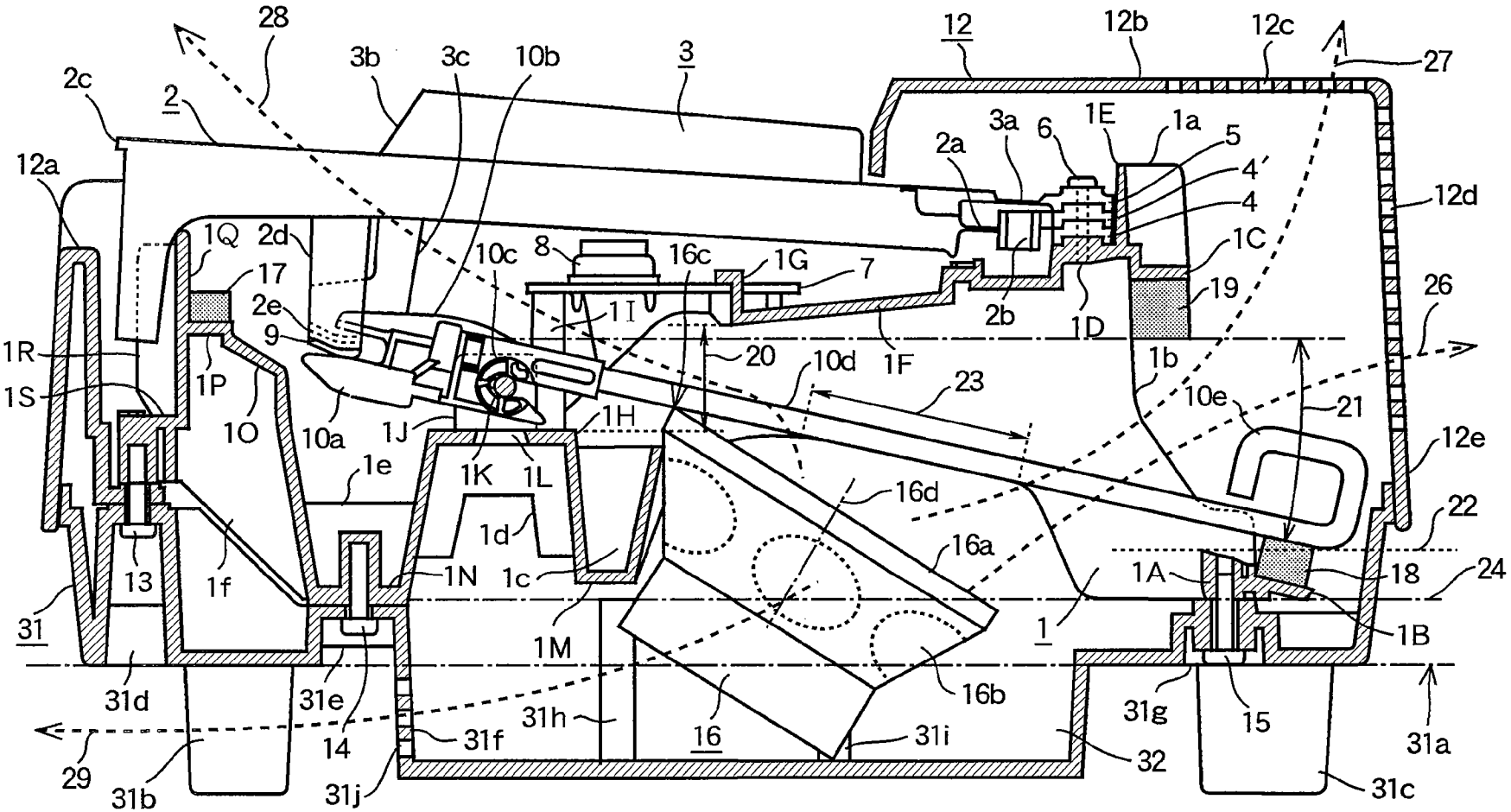
FIG. 2 is an explanation view illustrating a second embodiment of the present invention.

FIG. 2 is an explanation view illustrating a second embodiment of the present invention. Similarly to FIG. 1, FIG. 2 is a schematic sectional view when seeing an electronic keyboard instrument from the right side. The respective parts are sectioned on different planes. The same parts as shown in FIG. 1 are denoted by the same reference numerals.

This embodiment has a difference in the arrangement of the speaker unit 16 from the embodiment shown in FIG. 1.

In also this embodiment, the mass body pivot supporting part 1J is mounted such that the pivot point part 10*c* is positioned higher than the lowermost descending position 22 when the inertia generating part 10*d* of the mass body 10 pivots to the lower limit position. The speaker unit 16 is accommodated in the space below the inertia generating part 10*d*, such that the uppermost portion 16*c* of the speaker unit 16 is positioned higher than the lowermost descending position 22 of the inertia generating part 10*d*.

Moreover, the upper end (uppermost portion) 16*c* of the front opening part of the speaker unit 16 is positioned higher than the lower edge of the rib 1*b*. Because the rib 1*b* is not mounted to all the gaps of the adjacent mass bodies 10, the above arrangement can be achieved.

The concave part 31 may be extended in the key arranging direction (width direction of the keyboard). Otherwise, the concave part 31 may be formed only left and right areas for receiving therein the left and right speaker units 16, respectively.

When the diameter of the speaker unit 16 and the tilt angle of the central axis 16*d* of the front opening part 16*a* are the same as shown in FIG. 1, a depth of a concave part 32 of a lower case 31 is shallower than that of the concave part 25 of the lower case 11 shown in FIG. 1. Therefore, the height of the electronic keyboard instrument is shortened.

Because parts of the lower case 31, which are denoted by reference numerals 31*a* to 31*j*, are the same as the parts 11*a* to 11*j* of the lower case 11 shown in FIG. 1, the explanation thereof will be omitted.

Also in this embodiment, a similar shape as applied to the front surface portion 31*f* having the sound emitting holes 31*j* may be applied to a part of the keyboard frame 1 rather than the lower case 31. Stated otherwise, the sound emitting holes 31*j* may be formed in the keyboard frame 1 in case that the keyboard frame 1 and the lower case 31 are formed integrally with each other.

Figure 3:
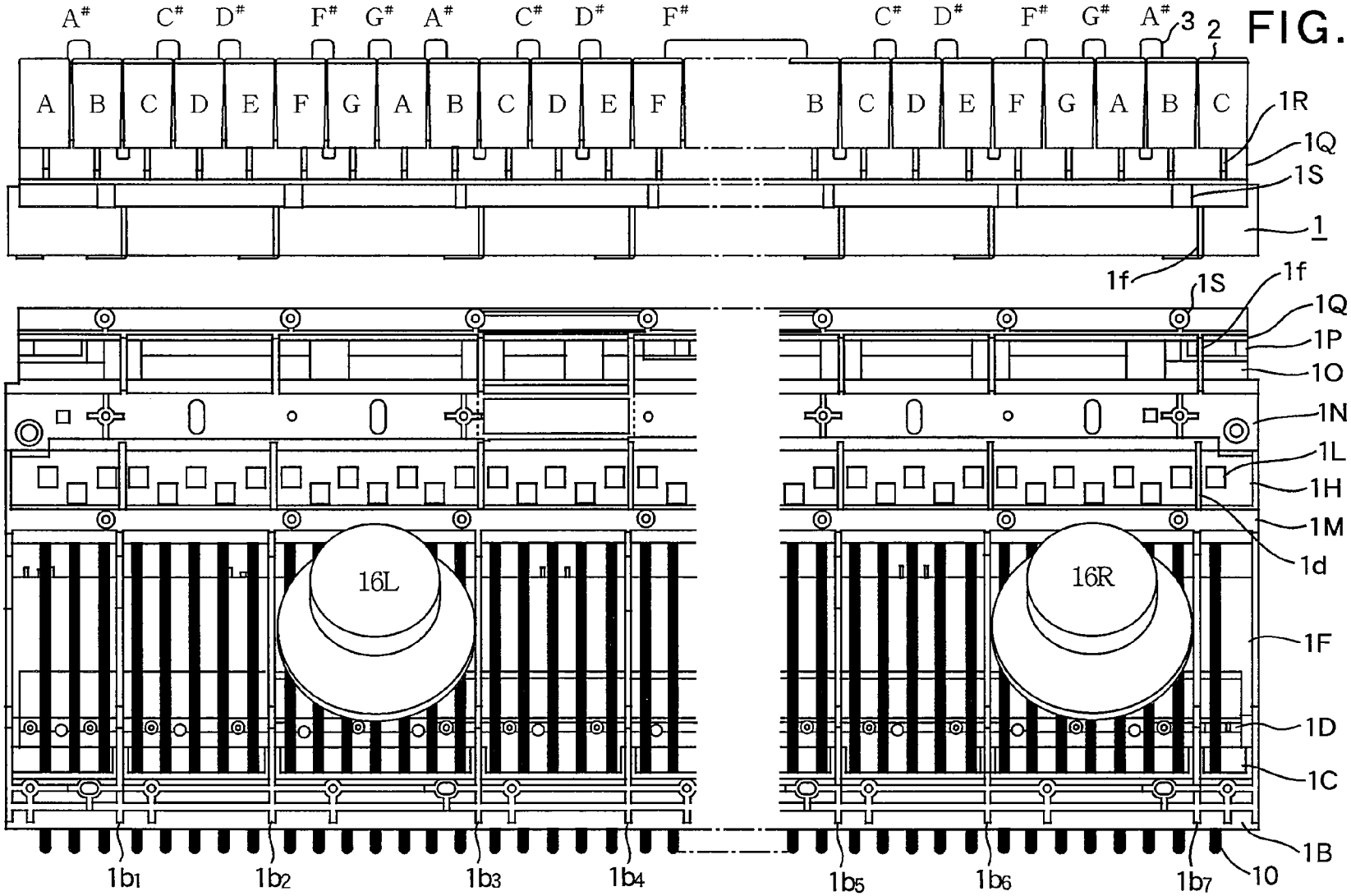
FIG. 3 is a bottom view when seeing a keyboard frame and speaker units from below in the second embodiment depicted in FIG. 2.

FIG. 3 is a bottom view illustrating the keyboard frame 1 and the speaker units 16 (left speaker 16L, right speaker 16R) when seen from below, with exclusion of the lower case 31 in the electronic keyboard instrument according to the second embodiment depicted in FIG. 2. A front view is included at the left portion on FIG. 2. The illustration of the middle portion of the keyboard is omitted.

The keyboard has 88 keys, from the key A of a note number 21 to the key C of a note number 108. In the drawing, the same parts as shown in FIG. 2 are denoted by the same reference numerals.

The partition ribs 1*b* (1$b_1$ to 1$b_7$) are formed at the gaps between the adjacent mass bodies of the white keys (between pitch name B and pitch name C, between pitch name E and pitch name F).

In disposing the speaker units 16L and 16R having the largest diameter in the region in which the ribs 1*b* are not formed, it is preferred that both ends of each of the speaker units 16L and 16R in the key arranging direction are located at the positions of the ribs 1*b* which are spaced apart from each other by the largest gap. Accordingly, any size of speakers having an opening diameter smaller than the speaker units 16L and 16R depicted in FIG. 1 can be mounted in the area where the rib 1*b* does not interfere.

The drawing illustrates that the left speaker unit 16L is disposed between the rib 1$b_2$ formed between the pitch name E and the pitch name F and the rib 1$b_3$ formed between the pitch name B and the pitch name C. The right speaker unit 16R is disposed between the rib 1$b_6$ formed between the pitch name E and the pitch name F and the rib 1$b_7$ formed between the pitch name B and the pitch name C. At this time, the centers of the speaker units 16L and 16R in the key arranging direction are located at the positions of the black keys G♯.

In this state, the speaker units 16L and 16R are arranged asymmetrically in the left/right direction. However, the electronic keyboard instrument has spaces in which the keys are not arranged, on the high-pitched side and the low-pitched side of the keyboard.

Accordingly, by adjusting the widths of the spaces, it is possible to arrange the speaker units 16L and 16R symmetrically in the left/right direction of the case.

Also, because the speaker units 16L and 16R are formed in a circular or an elliptical shape and have a predetermined inclination, although the center of each speaker unit 16 in the key arranging direction is shifted to a certain extent from the position of the black key $G^{\sharp}$, each speaker unit 16 can be disposed at the lower peripheral position of the rib 1*b* without interference. Accordingly, the speaker units 16L and 16R can be more increased in diameter, or can be arranged approximately to the symmetrical positions in the key arranging direction.

Similar to the embodiment which has been explained with reference to FIG. 1, in the space between the pivot lower limit position of the mass inertia generating part 10*d* and the bottom plate of the lower case 31, in which a speaker unit 19 is accommodated, an electric circuit part, a battery case and the like which are not shown are accommodated, being arranged in the direction of the key arrangement with respect to the speaker unit, on the bottom plate of the concave part 32 (in the case of the concave part 32 extended in the direction of key arrangement) or on the bottom plate of the bottom surface portion 31*a* (in the case of the concave part 32 formed only in a zone where the speaker unit 16 is located, in the direction of key arrangement).

Figure 4:
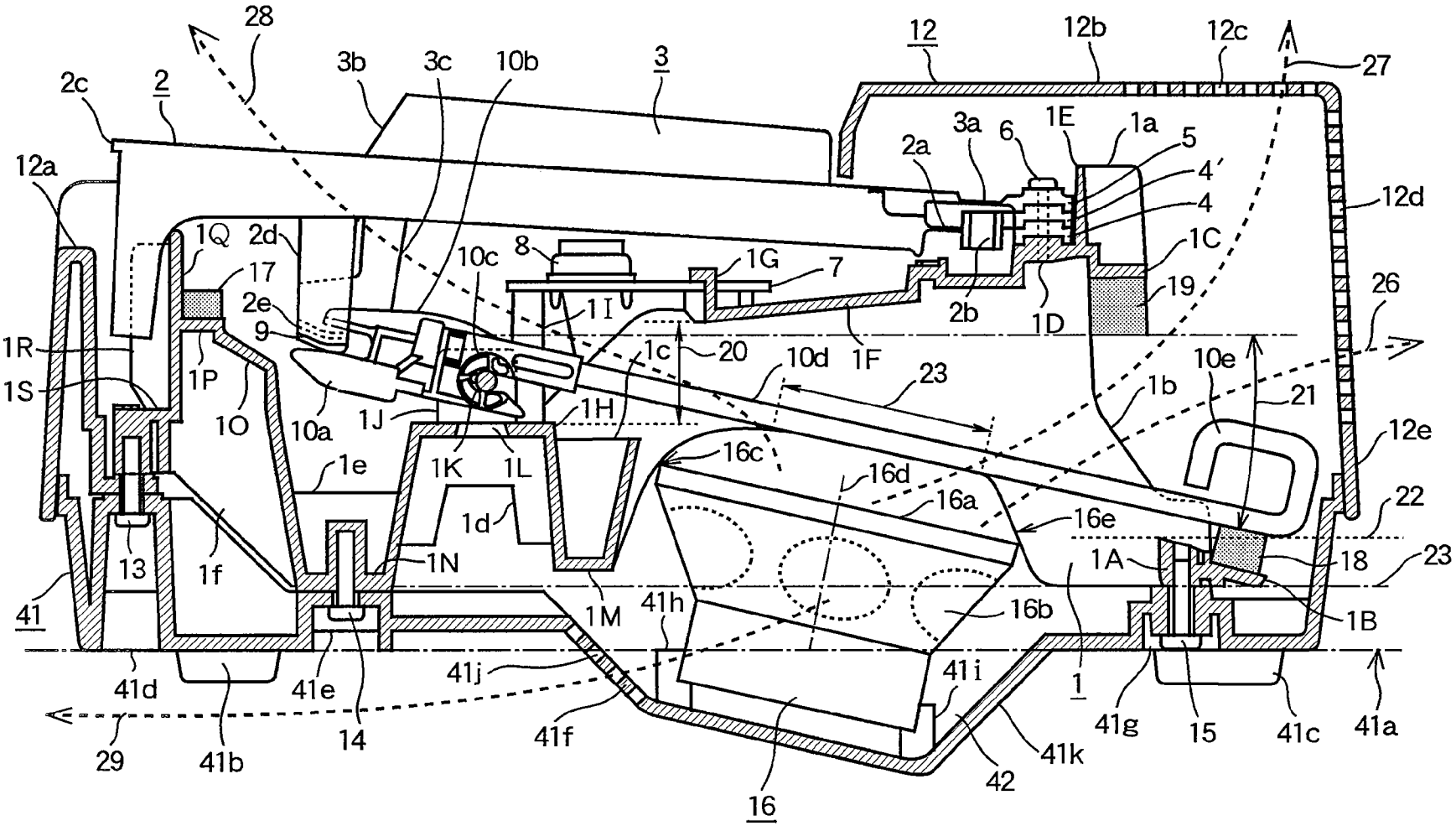
FIG. 4 is an explanation view illustrating a third embodiment of the present invention.

FIG. 4 is an explanation view illustrating a third embodiment of the present invention. Similarly to FIG. 1, FIG. 4 is a schematic sectional view when seeing an electronic keyboard instrument from the right side. The respective parts are sectioned on different planes.

The same parts as shown in FIG. 1 are denoted by the same reference numerals. This embodiment has a difference in the arrangement of the speaker unit 16 from the embodiment shown in FIG. 1.

The upper end 16*c* of the front opening part 16*a* of the speaker unit 16, i.e., the uppermost portion of the speaker unit 16 is positioned at the height of a curved portion formed at the front of the portion 23 of the lower edge of the rib 1*b*, or positioned near the height of the curved portion. A lower end 16*e* of the front opening part 16*a* of the speaker unit 16 is positioned at the height of a curved portion formed at the rear of the portion 23 of the lower edge of the rib 1*b*, or positioned near the height of the curved portion.

The front opening part 16*a* of the speaker unit 16 is in parallel or almost parallel with the inertia generating part 10*d* of the mass body 10 when the inertia generating part 10*d* pivots to the lower limit position (position shown in the drawing). The central axis 16*d* of the front opening part 16*a* of the speaker unit 16 is inclined rearward from the vertically up direction. However, when compared to the structures shown in FIGS. 1 and 2, the central axis 16*d* of the front opening part 16*a* is closer to the vertical direction.

A bottom surface portion 41*a* of the lower case defines a base part of the lower case. The lower case 41 is provided with a concave part 42 and pedestal parts 41*b* and 41*c* below the bottom surface portion 41*a*. The pedestal parts 41*b* and 41*c* are short such that lower ends of the pedestal parts 41*b* and 41*c* are positioned higher than a bottom surface of the concave part 42. Accordingly, by affixing legs to the pedestal parts 41*b* and 41*c*, the electronic keyboard instrument is used as a console type.

The concave part 42 may be extended in the key arranging direction (width direction of the keyboard). Otherwise, the concave part 42 may be formed at only left and right areas for receiving therein the left and right speaker units 16, respectively.

A front surface portion 41*f* of the lower case 41 is directed to the front down direction, and the acoustic wave outputted from the rear opening parts 16*b* of the speaker unit 16 is radiated in the slant lower front direction through sound emitting holes 41*j* formed at the front surface portion 41*f*.

A rear surface portion 41*k* of the lower case 41 may be provided with sound emitting holes, through which the acoustic wave from the rear opening parts 16*b* is radiated in the slant lower rear direction.

Because parts denoted by reference numerals 41*d*, 41*e*, 41*g*, 41*h* and 41*i* are the same as the parts 11*d*, 11*e*, 11*g*, 11*h* and 11*i* in FIG. 1, the explanation thereof will be omitted.

Also in this embodiment, a similar shape as applied to the front surface portion 41*f* having the sound emitting holes 41*j* may be applied to a part of the keyboard frame 1 rather than the lower case 41. Stated otherwise, the sound emitting holes 41*j* may be formed in the keyboard frame 1 in case that the keyboard frame 1 and the lower case 41 are formed integrally with each other.

The speaker unit 16 can be disposed such that the rib 1*b* is positioned at the center of the front opening part 16*a* of the speaker unit 16 in the key arranging direction.

In other words, the upper end 16*c* of the front opening part 16*a* (uppermost portion of the speaker unit 16) is in contact with a curved portion formed at the front of the portion 23 of the lower edge of the rib 1*b*, and the lower end 16*e* of the front opening part 16*a* is in contact with a curved portion formed at the rear of the portion 23 of the lower edge of the rib 1*b*.

Describing with reference to FIG. 3, for example, the center of the front opening part of the speaker unit 16L in the key arranging direction is disposed at the position of the rib $1b_2$, and the center of the front opening part of the speaker unit 16R in the key arranging direction is disposed at the position of the rib $1b_6$.

In this case, the presence of the rib 1*b* does not become an obstacle to the spread of the acoustic wave radiated from the front opening part 16*a*. Also, the speaker units 16L and 16R are arranged almost symmetrically in the left/right direction.

Similar to the embodiment which has been explained with reference to FIG. 1, in the space between the pivot lower limit position of the mass inertia generating part 10*d* and the bottom plate of the lower case 41, in which a speaker unit 16 is accommodated, an electric circuit part, a battery case and the like which are not shown are accommodated, being arranged in the direction of the key arrangement with respect to the speaker unit, on the bottom plate of the concave part 42 (in the case of the concave part 42 extended in the direction of key arrangement) or on the bottom plate of the bottom surface portion 41*a* (in the case of the concave part 42 formed only in a zone where the speaker unit 16 is located, in the direction of key arrangement).

Figure 5:
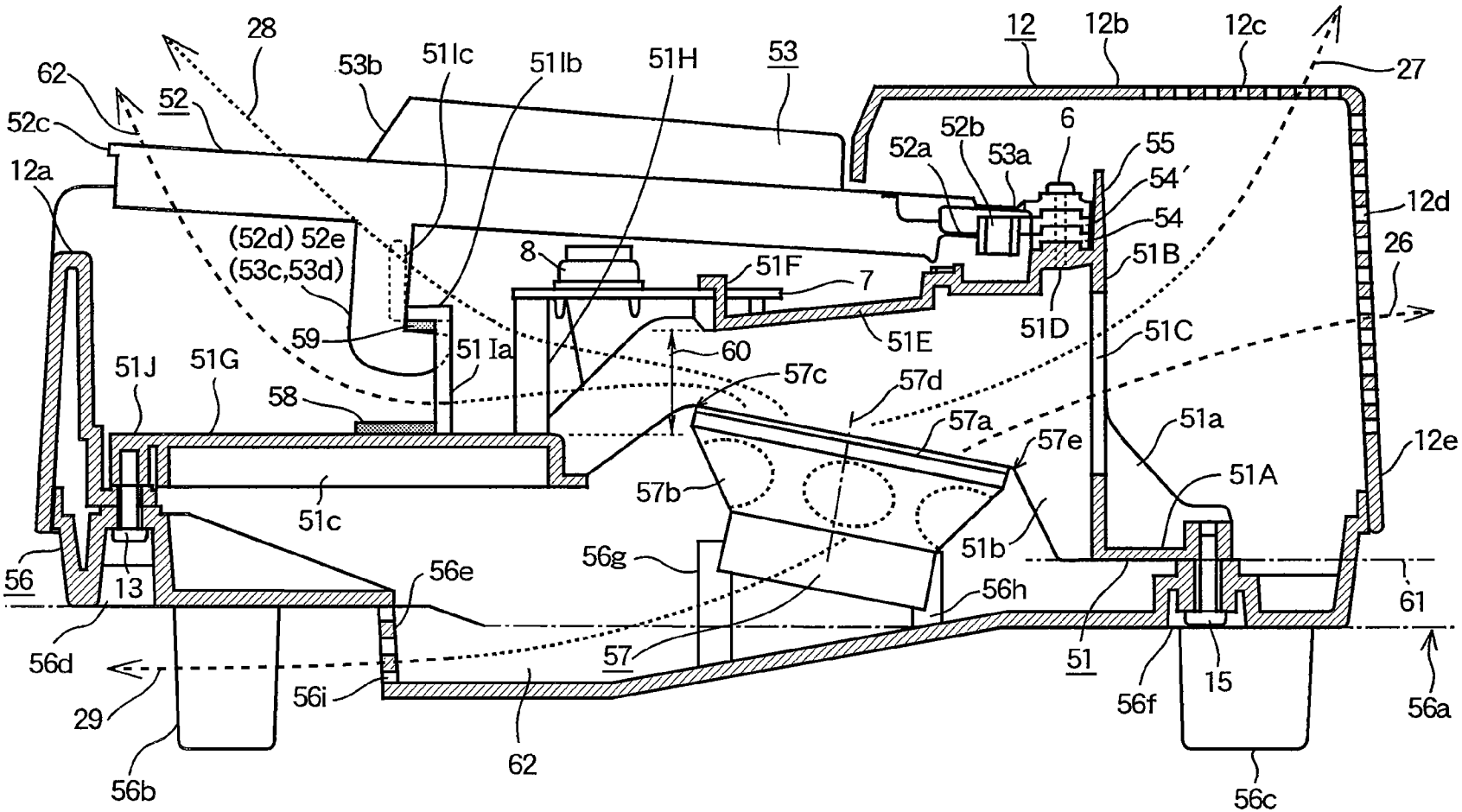
FIG. 5 is an explanation view illustrating a fourth embodiment of the present invention, wherein FIG. 5 (*a*) is a schematic sectional view when seeing an electronic keyboard instrument from the right side, and FIG. 5 (*b*) is a partial view when seeing a key guide part from the rear.
Figure 5:
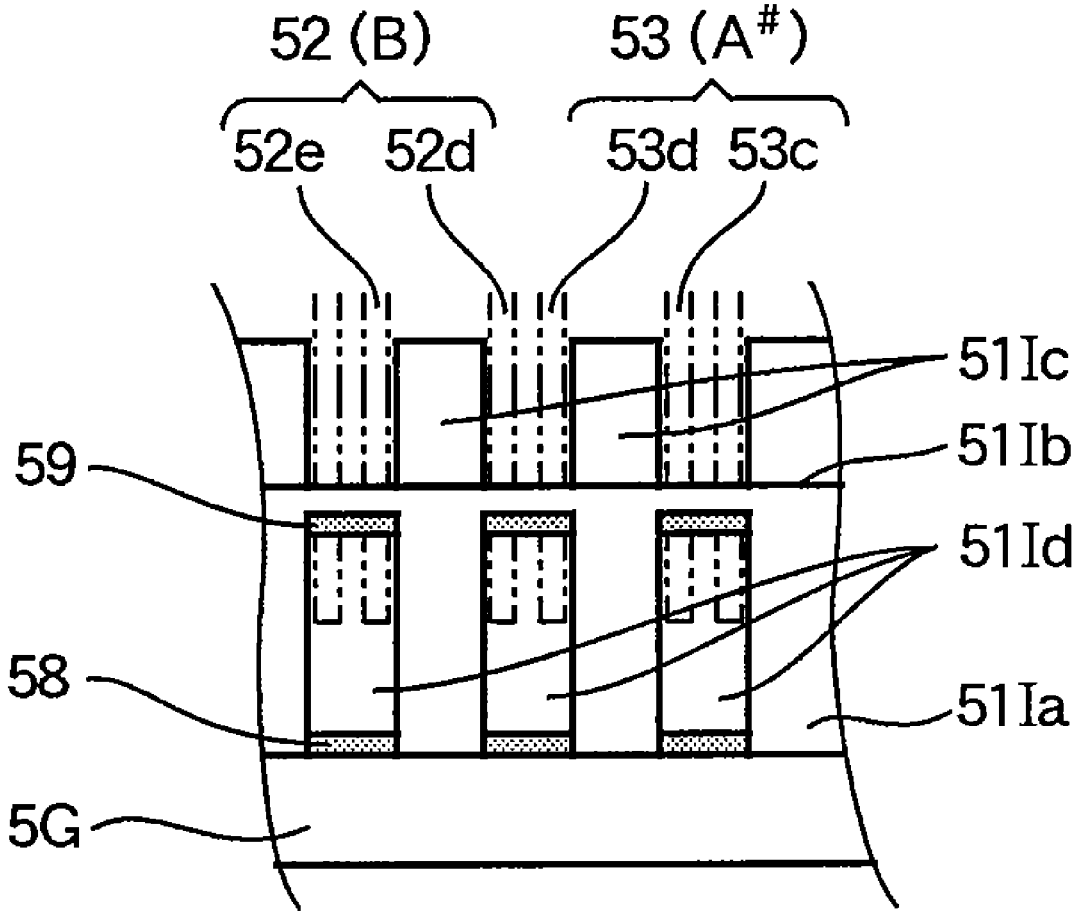

FIG. 5 is an explanation view illustrating a fourth embodiment of the present invention.

Similarly to FIG. 1, FIG. 5 (*a*) is a schematic sectional view when seeing an electronic keyboard instrument from the right side. The respective parts are sectioned on different planes. FIG. 5 (*b*) is a partial view when seeing a key guide part 51I from the rear.

A keyboard of this embodiment does not have a mass body.

A keyboard frame 51 is unitarily made of resin, however it may partially include a metal member.

The keyboard frame 51 is sectioned into a rear lower part 51A which is located at a rear lower portion, a rear vertical wall 51B, upper parts 51D, 51E and 51F which are located over an upper area from a middle portion in the longitudinal direction to a rear portion, and front lower parts 51G, 51H, 51I and 51J which are located at a front lower portion. The respective parts extend in the key arranging direction.

The above parts are reinforced by a plurality of partition ribs 51*a*, 51*b* and 51*c*. The ribs have a thin flat plate shape, and extend in the longitudinal direction of the key and in the up/down direction.

Of them, the rib 51*b* couples the rear lower part 51A, the rear vertical wall 51B, the upper parts 51D to 51F, and the front lower parts 51G to 51J. Consequently, the partition ribs 51*b* extend downward from the upper part extending along the key arranging direction.

The respective ribs 51*a*, 51*b* and 51*c* can be mounted to any positions in the key arranging direction. Similarly to the second embodiment described with reference to FIG. 3, the ribs 51*a*, 51*b* and 51*c* can be mounted in the gaps formed between the adjacent white keys.

The rear vertical wall 51B is provided with one or more holes 51C (for example, slits formed in the vertical direction), which function as a sound passage. Or, the rear vertical wall 51B itself may be eliminated, and the ribs 51*b* may be used to couple the rear lower part 51A and the upper parts 51D to 51F. In this case, the gaps between the adjacent ribs 51*b* become the sound passages.

As shown in the drawing, the upper case 12 which is the same as described above is used.

It is illustrated in the drawing that the keyboard frame (supporting member) 51 is provided separately from a lower case 56, however the keyboard frame 51 may be integrally formed with the lower case 56. The lower case 56 may have the same shape as the lower cases 11, 31 and 41 which are described above, however the shape of the lower case 56 in this embodiment is slightly modified. A concave part 62 and pedestal parts 56*b* and 56*c* are mounted below a bottom surface portion 56*a* of the lower case 56. Long legs can be affixed to the pedestal parts 56*b* and 56*c*, or the lower case 56 can be loaded on a frame stand having legs.

The key body part (white key) 52 and the key body part (black key) 53 are made in the same units as described above. A horizontal hinge part 52*a* and a left/right hinge part 52*b* are used as a key supporting part of the white key, and a horizontal hinge part 53*a* is used as a key supporting part of the black key. Common base parts 54, 54' and 55 have the same constitution as the common base parts described above.

The key body part (white key) 52 is provided with left and right stopper pieces (white key) 52*d* and 52*e*, and the key body part (black key) 53 is provided with left and right stopper pieces (black key) 53*c* and 53*d*.

A front end of each stopper piece is positioned just below a front end portion 53*b* of the key body part (black key) 53. The stopper pieces (white key) 52*d* and 52*e* are respectively protruded downward from left and right side surface portions of the key body part (black key) 52. Front ends of the stopper pieces (white key) 52*d* and 52*e* are bent in the rear direction to be formed in an L shape. The stopper pieces (black key) 53*c* and 53*d* are the same shapes as described above.

In FIG. 5 (*b*), the key body part (white key) 52 refers to a key of pitch name B, and the key body part (black key) 53 refers to a key of pitch name $A^{\sharp}$.

A reference numeral 57 refers to a speaker unit, which has a thickness thinner than the speaker unit 16 described above.

The speaker unit 57 is disposed on the concave part 62 of the lower case 56 in the space between the keyboard (key body part (white key) 52, key body part (black key) 53) and the bottom plate of the lower case 56, and is mounted to speaker supporting parts 56*g* and 56*h* which are protrudingly formed on a bottom surface plate of the concave part 62 of the lower case 56 by screw coupling, engagement, etc. The concave part 56 may be extended in the key arranging direction (width direction of the keyboard). Otherwise, the concave part 56 may be formed only left and right areas for receiving therein the left and right speaker units 57, respectively.

A lower edge of the rib 51*b* is upwardly convex, and is tilted rearward. The speaker unit 57 is arranged such that a front opening part 57*a* of the speaker unit 57 is disposed along the lower edge of the rib 51*b*. A central axis 57*d* of the front opening part 57*a* is inclined rearward from the vertically up direction.

Because at least a portion of the speaker unit 57 can be disposed in the space higher than the position of a lower end 61 of the keyboard frame 51, although the speaker unit 57 having a large diameter is contained, the height of the electronic keyboard instrument can be restricted.

Meanwhile, when seeing in the key arranging direction, similarly to the third embodiment described above with reference to FIG. 4, the speaker unit 57 may be arranged such that the rib 51*b* is positioned at the center of the front opening part 57*a* of the speaker unit 57 in the key arranging direction.

In other words, an upper end 57*c* of the front opening part 57*a* (uppermost portion of the speaker unit 57) and a lower end 57*e* of the front opening part 57*a* are in contact with the lower edge of the rib 51*b*.

As a result, the rib 51*b* does not become an obstacle to the spread of the acoustic wave radiated from the front opening part 57*a*. Also, if arranged identically to the third embodiment, left and right speaker units 57L and 57R (not shown) are arranged almost symmetrically in the left/right direction.

An electronic circuit substrate, which is equipped with a musical sound signal generating part and a control CPU, a battery case and the like can be accommodated in a space in which the speaker units 57L and 57R are not disposed.

Similar to the embodiments which have been explained with reference to FIGS. 1 and 2, the speaker unit 57 may be accommodated between adjacent ribs 51*b* formed at positions where white keys are adjacent to each other in the direction of key arrangement. The opening diameter of the speaker 57 may be enlarged or the height of the electronic keyboard instrument may be increased without the ribs hindering the arrangement of the speaker unit by the ribs.

In the space between the keyboard and the bottom plate of the lower case 56, in which the speaker units 57L, 57R are accommodated, an electronic circuit part, a battery case and the like which are not shown may be accommodated, being arranged in the direction of key arrangement with respect to the speaker units, on the bottom plate of the concave part 62 (in the case of the concave part 62 extended in the direction of key arrangement), or on the bottom plate of the bottom surface portion 56*a* (in the case of the concave part 62 formed only in a zone in the direction of key arrangement, where the speaker units 57L, 57R are arranged). It is noted here that the electric circuit parts includes a music sound processing electric circuit part (for example, an electronic circuit board on which a music sound signal generating part, a control CPU and the like are mounted and an amplifier), a circuit part for plugs and jacks (external connecting terminals).

Sound passages of the acoustic wave radiated to the outside of the case from the speaker unit 57 are as follows.

First sound passages 26 and 27 are defined from the front opening part 57*a* to the outside, via a plurality of holes 51C formed at the rear vertical wall 51B, a plurality of sound emitting holes 12*d* formed at the rear surface portion 12*e*, and a plurality of sound emitting holes 12*c* formed at the rear upper surface portion 12*b*.

Second sound passages 28 and 62 are defined from the front opening part 57*a* to the outside, via gaps of the keyboard frame 51 (which will be described later) and gaps of a plurality of keys including the key body parts (white keys) 52 and the key body parts (black keys) 53.

It is illustrated in the drawing that the gaps of the keyboard frame 51 are secured by a gap part 60 formed between the upper parts 51D, 51E and 51F and the front lower parts 51G, 51H, 51I and 51J and gaps of the key guides 51I (which will be described later).

A third sound passage 29 is defined from rear opening parts 57*b* of the speaker unit 57 to the outside, via a plurality of sound emitting holes 56*i* formed at a front surface portion 56*e* of the concave part 62 of the lower case 56. Because the concave part 62 is mounted below the bottom surface portion 56*a* of the lower case 56 and the concave part 62 is slanted forward, although the height of the whole case is restricted to be low, the acoustic wave can be easily radiated in the front down direction.

The aforesaid sound emitting holes 56*i* may be formed as horizontal or vertical slits or small circular holes, or may be configured as a large opening part (sound emitting hole) to which a punching metal or a speaker net is attached.

Also in this embodiment, a similar shape as applied to the front surface portion 56*e* having the sound emitting holes 56*j* may be applied to a part of the keyboard frame 51. Stated otherwise, the sound emitting holes 56*j* may be formed in the keyboard frame 51 in case that the keyboard frame 51 and the lower case 56 are formed integrally with each other.

Hereinafter, the detailed structure of the electronic keyboard instrument will be described with an emphasis on the structure of the keyboard frame 51.

The rear coupling part 51A is provided at the rear lower portion of the keyboard frame 51. The rear coupling part 51A of the keyboard frame 51 is fixedly joined with a rear coupling part 56*f* of the lower case 56 by a setscrew 15. The rear vertical wall 51B is provided at the front of the rear coupling part 51A.

A key installing part 51D is provided at the front of an upper end of the rear vertical wall 51B. A slanted surface part 51E is extended forward from the key installing part 51D while being slanted gently from the horizontal surface. A switch substrate installing part 51F having a latching hook shape is protrudingly formed at a front end of the slanted surface part 51E.

A front horizontal pedestal part 51G is provided at a distance from the front end of the slanted surface part 51E by the gap part 60 in the front down direction. A boss-shaped switch substrate installing part 51H is protrudingly formed at a rear end of the front horizontal pedestal part 51G.

The switch substrate 7 is installed to the keyboard frame 51 by the switch substrate installing parts 51G and 51H.

A key guide part 51I, which extends in the key arranging direction, is uprightly mounted on the front horizontal pedestal part 51G. The key guide part may be formed separately from the keyboard frame 51 and fixed to the keyboard frame 51.

As shown in FIG. 5(*b*), the key guide part 51I includes a vertical wall 51Ia, a horizontal pedestal part 51Ib which extends forward while being bent perpendicularly to an upper end of the vertical wall 51Ia, and guide pieces 51Ic which extend vertically from a front end of the horizontal pedestal part 51Ib, correspondingly to the respective keys. The vertical wall 51Ia is provided with slits 51Id, into each of which the stopper pieces formed at two opposing side surfaces between two adjacent keys are inserted.

For instance, the front end portion of the stopper piece 52*d* protruding from the left side surface (right side when seen from the rear) of the key body part (white key) 52 of pitch name B and the front end portion of the stopper piece 53*d* protruding from the right side surface (left side when seen from the rear) of the key body part (black key) 53 of pitch name A♯ (which is disposed adjacent to the key body part (white key) 52 of pitch name B), are inserted into the same slit 51Id.

The guide pieces 51Ic are mounted correspondingly to the respective keys. Between the stopper pieces 52*d* and 52*e* of the key body part (white key) 52 of pitch name B is interposed the guide piece 51Ic corresponding to the key body part 52. Between the stopper pieces 53*c* and 53*d* of the key body part (black key) 53 of pitch name A♯ is interposed the guide piece 51Ic corresponding to the key body part 53. Accordingly, the respective keys are restricted in position in the transverse direction by the guide pieces.

A lower limit stopper 58 made of a felt material is attached in a belt shape onto the front horizontal pedestal part 51G, just below the stopper pieces 52*d*, 52*e*, 53*c* and 53*d*. An upper limit stopper 59 made of a felt material is attached in a belt shape onto the lower surface of the horizontal pedestal part 51Ib of the key guide part 51I.

Due to the above-described constitution of the key guide part 51I, the gaps between the adjacent guide pieces 51Ic and a plurality of slits 51Id become a portion of the second sound passages 28 and 62.

A front coupling part 51J is provided at a front end of the front horizontal pedestal part 51G. The front coupling part 51J contacts a front coupling part 56*d* of the lower case 56, and is fixed together by a setscrew 13.

The above embodiments are configured such that the acoustic wave of the reverse phase outputted from the rear opening parts 16*b* and 57*b* of the speaker units 16 and 57 is radiated through the sound emitting holes formed at the front surface of the lower case, however the sound emitting holes formed at the front surface of the lower case may be eliminated.

Also, a speaker box may be installed inside the case body including the lower case and the upper case, and the speaker unit 16 or 57 may be contained in the speaker box. By disposing a speaker box having a large inner capacity in a space between the left speaker unit and the right speaker unit, it is also possible to improve the acoustic characteristics.

Figure 6:
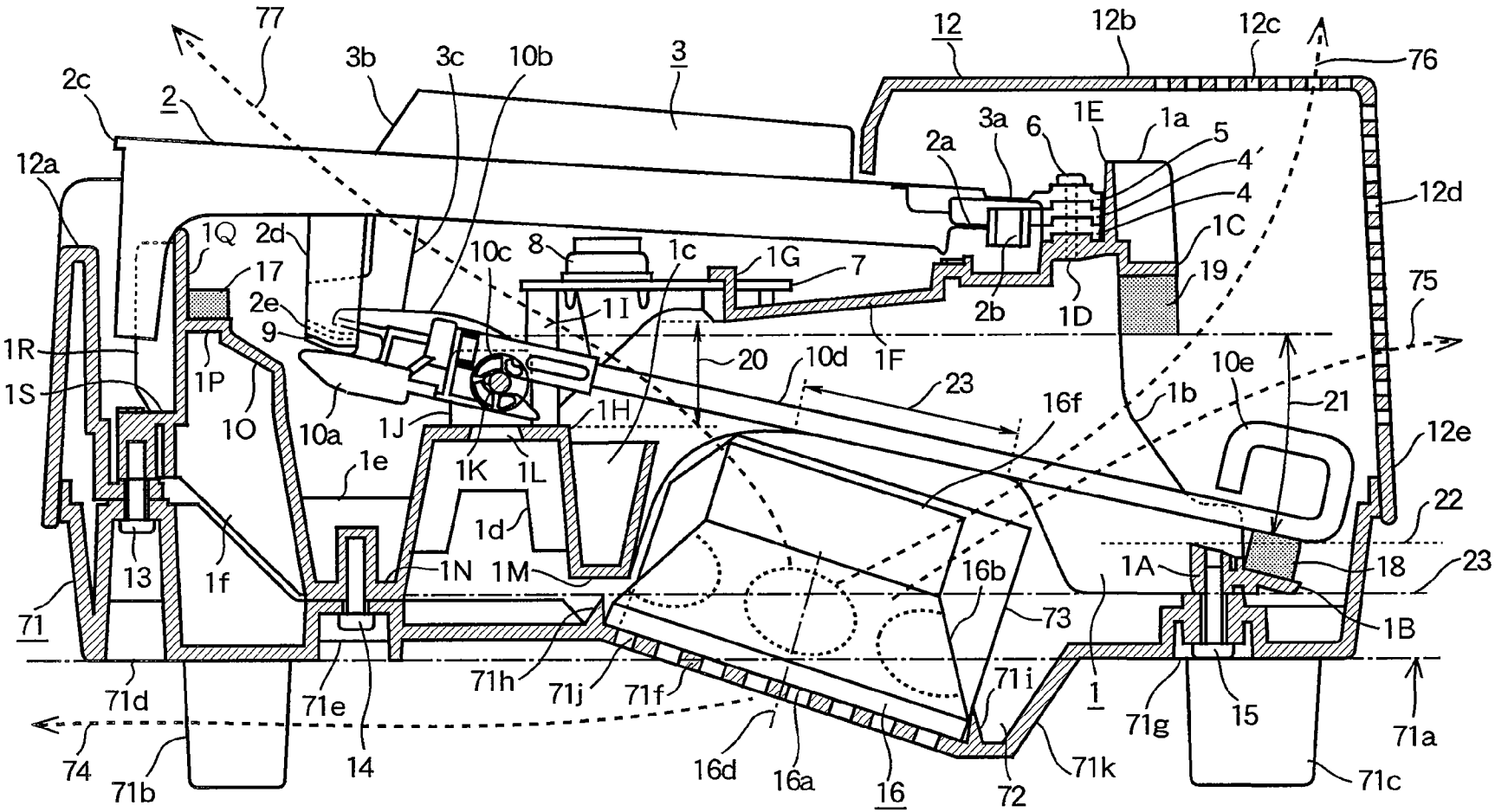
FIG. 6 is an explanation view illustrating a fifth embodiment of the present invention.

FIG. 6 is a view for explaining a fifth embodiment of the present invention. This embodiment is a variant of the third embodiment which has been explained with reference to FIG. 4. Similar to FIG. 1, this figure is a schematic sectional view illustrating an electronic keyboard instrument as viewed from the right side surface thereof, parts being cut by different planes.

Like reference numerals are used to denote like parts to those shown in FIG. 4 and FIG. 1 which is an antecedent of this figure.

This embodiment is the same as that of the embodiment shown in FIG. 4, except that the speaker unit is arranged being bi-axially inverted (inverted top and bottom and left and right).

In the example shown in the figure, the keyboard frame 1 and the lower case are formed being separated from each other. However, they may be integrally incorporated with each other. Similar to the embodiment which has been explained with reference to FIG. 4, the center line of the mount position of the speaker unit 16 in the direction of key arrangement, is located at a position where the rib (longitudinal wall rib) 1*b* is formed. Accordingly, even though the rib is present, the rib 1*b* can hardly hinder the propagation of sound waves from the rear opening parts 16*b*. Further, the left and right speaker units are arranged, substantially left-and -right symmetric.

An upper end of a magnetic circuit part 16*f* of the speaker unit 16, i.e., the uppermost portion of the speaker unit 16 is positioned at the height of a curved portion formed at the front of the portion 23 of the lower edge of the rib 1*b*, or positioned near the height of the curved portion.

The magnetic circuit part 16*f* of the speaker unit 16 is in parallel or almost parallel with the inertia generating part 10*d* of the mass body 10 when the inertia generating part 10*d* pivots to the lower limit position (position shown in the drawing). As a result, the central axis 16*d* of the front opening part 16*a* of the speaker unit 16 is inclined forward from the vertically down direction.

Also, because the speaker unit 16 is typically configured such that the magnetic circuit part 16*f* has a diameter smaller than the front opening part 16*a*, the position of the rib 1*b* in the key arranging direction is hardly subject to restriction. To this end, it can be easily achieved to dispose the speaker units 16 in the key arranging direction such that the upper end of the magnetic circuit part 16*f* is positioned below the lower edge of the rib 1*b*.

A concave part 72 and pedestal parts 71*b* and 71*c* are mounted below a bottom surface portion 71*a* of a lower case 71 which defines a base. Lower ends of the pedestal parts 71*b* and 71*c* are located at positions lower than a bottom surface of the concave part 72. By affixing legs to the pedestal parts 71*b* and 71*c*, or by loading the lower case 71 on a frame stand having legs, the electronic keyboard instrument can be used as a console type. The concave part 72 may be extended in the arranging direction of the key, or may be formed in only the left and right positions which are sectioned to respectively accommodate the left and right speaker units 16.

Within the space between the pivot lower limit position of the mass inertia generating part 10*d* and the bottom plate of the lower case 71, in which the speaker unit 16 is accommodated, there is presented a space in which no speaker unit is accommodated, and in which an electronic circuit 73, a battery case and the like are accommodated, being arranged in the direction of key arrangement with respect to the speaker unit 16, on the bottom plate of the concave part 72, that is, the bottom plate of the front surface portion 71*a* (in the case of the concave part 72 extended in the direction of key arrangement), or on the bottom plate of the bottom surface portion 71*a* (in the case of the concave part 72 formed only in zone, in the direction of key arrangement, where the speaker unit 16 is arranged). It is noted here that the electric circuit part 73 includes a music sound processing circuit (for example, an electronic circuit part 72 a music sound signal generating part and a control CPU, an amplifier) and a circuit part for plugs and jacks (external connecting terminals).

The front opening part 16*a* of the speaker unit 16 is mounted to a front surface portion 71*f* of the concave part 72 of the lower case 71, which is directed to the front down direction, by using a screw (not shown), an adhesive agent, or the like. When compared to the front surface portion 41*f* shown in FIG. 4, the front surface portion 71*f* has a gentle inclination. Reference numerals 71*h* and 71*i* refer to protruding parts for temporarily positioning the speaker unit 16. In order to avoid using a slide core when forming the lower case 71 by a mold, the protruding parts 71*h* and 71*i* have a section of a triangular shape as shown in the drawing. Because parts denoted by reference numerals 71*d*, 71*e* and 71*g* are the same as the parts 11*d*, 11*e* and 11*g* in FIG. 1, the explanation thereof will be omitted.

Because the speaker unit 16 is accommodated such that the central axis 16*d* of the front opening part 16*a* is inclined forward from the vertically down direction, the acoustic wave outputted from the front opening part 16*a* of the speaker unit 16 is radiated in the slant lower front direction through a plurality of sound emitting holes 71*j* formed at the front surface portion 71*f* as a first sound passage 74.

When the electronic keyboard instrument is put on a desk, the acoustic wave is radiated forward through a sound passage which is formed between the bottom surface portion 71*a* and the desk by the pedestal parts 71*b* and 71*c*.

A similar shape as applied to the front surface portion 71*f* having the sound emitting holes 71*j* may be applied to a part of the keyboard frame 1 rather than the lower case 71. Stated otherwise, the sound emitting holes 71*j* may be formed in the keyboard frame 1 in case that the keyboard frame 1 and the lower case 71 are formed integrally with each other.

When radiating the acoustic wave from a plurality of rear opening parts 16*b* mounted to the speaker unit 16 to the outside, it is preferred that the acoustic wave is set to be radiated to the outside through second sound passages 75 and 76, which are the same as the first sound passages 26 and 27 described with reference to FIG. 4, and a third sound passage 77, which is the same as the second sound passage 28 described with reference to FIG. 4.

On the other hand, if the acoustic wave from the rear opening parts 16*b* is set not to be radiated to the outside, the sound emitting holes 12*d* formed at the rear surface portion 12*e* of the upper case 12 and the sound emitting holes 12*c* formed at the rear upper surface portion 12*b* of the upper case 12 may be eliminated.

In manner similar to the embodiment described in conjunction with FIG. 2 and FIG. 3, the speaker unit 93 may be accommodated between the adjacent ribs 91*b*. The rib 91*b* may not interfere with the arrangement of the speaker unit, while an opening diameter of the speaker unit 93 is enlarged or the height of the electronic keyboard instrument is reduced.

When compared to the third embodiment described with reference to FIG. 4, the aforesaid modified example has features in the change of the overall shape of the lower case and the arrangement of the sound emitting holes, as well as the both-axis inversion of the arrangement of the speaker unit 16. However, it does not matter if the structures shown in FIGS. 1, 2 and 3 are modified only in the both-axis inversion of the arrangement of the speaker unit 16 without changing the overall shape of the lower case and the arrangement of the sound emitting holes. In such a case, it is necessary to change shapes and mount positions of the speaker supporting parts 11*h*, 11*i*, 31*h* and 31*i*.

Figure 7:
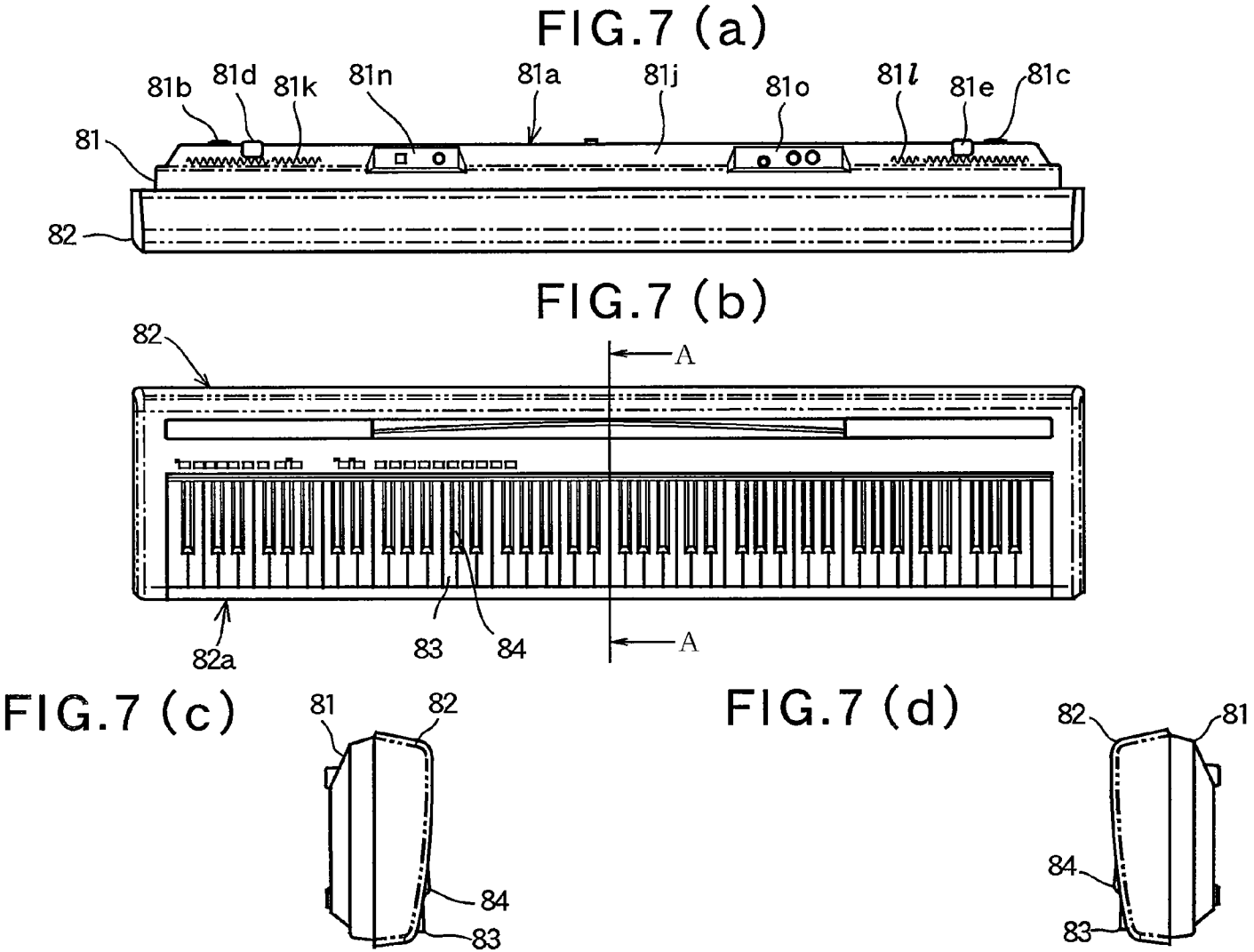
FIGS. 7(*a*)-7(*f*) are an explanation view illustrating a sixth embodiment of the present invention.
Figure 7:
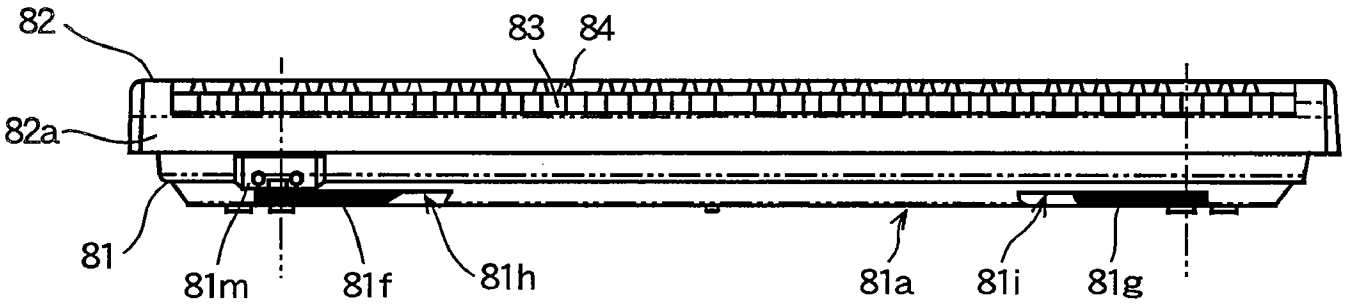
Figure 7:
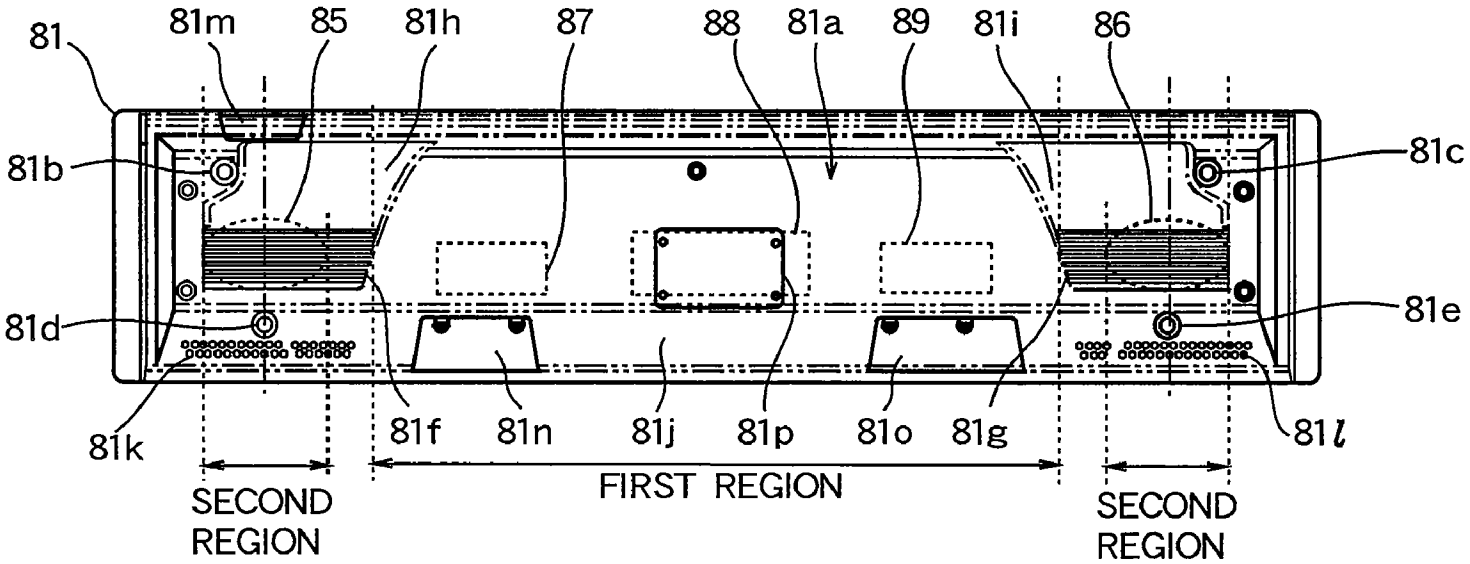

FIG. 7 is a view for explaining a sixth embodiment of the present invention, in which FIG. 7(*a*) is a rear view illustrating an electronic keyboard instrument, FIG. 7(*b*) is a plan view, FIG. 7(*c*) is a left side view, FIG. 7(*d*) is a right side view, FIG. 7(*e*) is a front view, and FIG. 7(*f*) is a bottom view.

The electronic keyboard instrument in this embodiment is adapted, similar to the electronic keyboard instrument shown in FIG. 6, to emit sound waves generated from an electric acoustic converter, into the outside, mainly through sound radiation holes, as an acoustic path, formed in the front lower part of the lower case.

In the figure, there are shown a lower case 81, an upper case 82, a mouth stick part 82*a*, key body parts (white keys) 83, and key body parts (black keys) 84. The key body parts (white keys) 83 and the key body parts (black keys) 84 are covered with the upper case 82, but parts of them which are subjected to key depression are exposed to the outside. The lower case 81 and the upper case 82 are fitted in part to each other, and are fastened together with a keyboard frame (refer to 91 in FIG. 8). In the example as shown, the key board frame and the lower case 81 are formed being separated from each other, but they may be integrally incorporated with each other.

As shown in FIG. 7(*f*), the structure of the bottom surface portion of the lower case 81 is different in the direction of e key arrangement. A pair of speaker units (electric acoustic converters)(refer to 93 in FIG. 8) are set on the bottom plate of the lower case 81 within the electronic keyboard instrument, the center axial directions of the front opening parts of the speaker units being inclined forward from the vertically downward direction.

In a first zone, in the direction of key arrangement, in which no speaker unit is set, there is formed a horizontal bottom surface part 81*a* serving as a base board. The horizontal bottom surface part 81*a* is provided with pedestal parts 81*b* to 81*e* which are directed downward. These pedestal parts 81*b* to 81*e* are adapted to be set on a table or to be attached thereto with long legs when the electronic keyboard instrument is used. Further, the horizontal bottom surface part 81*a* is adapted to be set on a frame with legs or to be fixed with legs so as to be used as a cabinet type electronic keyboard instrument.

In second zones, in the direction of key arrangement, in which the speaker units are set, the bottom portion is slanted forward so as to constitute forward slanted surface parts 81*f*, 81*g* which are formed therein with one or more of sound radiation holes.

The speaker units are mounted on the bottom plates of the forward slanted surface parts 81*a*, 81*g*. The mount positions 85, 86 for left and right speaker units are indicated by broken lines in the figure. In the example as shown, these mount positions 85, 86 are arranged, respectively nearer to the left end part side and the right end part side of the forward slanted surface parts 81*f*, 81*g* as viewed in the direction of key arrangement while the pedestal parts 81*d*, 814 are located on the center lines thereof.

In the direction of key arrangement, the center lines of these mount positions 85, 86 on which white keys are adjacent to each other are also at the positions where the ribs (longitudinal wall ribs) are provided. Accordingly, similar to the embodiment which has been explained with reference to FIG. 4, ribs 91*b* which are though present, can hardly hinder propagation of sound waves from the rear opening parts 93*b*. The left and right speakers are arranged, substantially left-and-right symmetric.

Further, one or more of sound radiation holes are formed at the positions 85, 86 at which the left and right speaker units are mounted on the above-mentioned forward slanted surface parts 81*f*, 81*g*. In the example shown in the figure, these holes are slits which may be not only extended in a horizontal (crosswise) direction but also extended in a vertical (longitudinal) direction. Further, they may be several circular holes having a small diameter. Alternatively, punched metal sheets or speaker nets may be attached to large aperture parts which are formed in the forward slanted surfaced parts 81*f*, 81*g*.

It is noted here that parts having the same shape as that of the forward slanted surface parts 81*f*, 81*g* formed therein with the sound radiation holes are formed not as a part of the lower case 81 but as a part of the keyboard frame. Further, in the case of the keyboard frame and the lower case 81 which are integrally incorporated with each other, the sound radiation holes may be possibly formed in the key board frame.

In the embodiment as shown, the forward slanted surface parts 81*f*, 81*g* are extended up to the front surface of the lower case 81 by way of the horizontal upper bottom surfaced parts 81*h*, 81*i*, in front of the keyboard. The sidewise width of the forward slanted surface parts 81*f*, 81*b* in the direction of key arrangement becomes wider forward. Further, the horizontal upper bottom surface parts 81*h*, 81*i* have such a shape that the sidewise width thereof in the direction of key arrangement becomes wider and wider forward. In the embodiment as shown, they are broadened near to their centers in the direction of key arrangement.

The left and right boundaries of the forward slanted surface parts 81*f*, 81*g* and the horizontal upper bottom surface parts 81*h*, 81*i* are stepped with respect the above-mentioned horizontal bottom surface part 81*a*. That is, the forward slanted surface parts 81*f*, 81*g* and the horizontal upper bottom surface parts 81*h*, 81*i* define concave parts with respect the horizontal bottom surface portion 81*a*, as viewed from the bottom surface side of the lower case 81.

It is noted that the horizontal upper bottom surface parts 81*h*, 8*ii* may be omitted. In this case, the forward slanted surface parts 81*f*, 81*g* are closely adjacent to the front surface of the lower case 81 on the front side of the keyboard.

The pedestal parts 81*b*, 81*c* as shown are provided downward from the horizontal surface part 81*a*. The positions of the pedestal parts 81*b*, 81*c* in the direction of key arrangement are located in the second zones where the speaker units are arranged as stated above. Thus, the boundaries of the horizontal upper bottom surface parts 81*h*, 81*i* are designed so that they detour the pedestal parts 81*b*, 81*c* in the vicinity thereof.

Alternatively, the horizontal upper bottom surface parts 81*h*, 81*i* may be formed without deterring the pedestal parts 81*b*, 81*c*, that is, the pedestal parts 81*b*, 81*c* are provided below the horizontal upper bottom surface parts 81*h*, 81*i*. In such a case that the positions where the pedestal parts 81*b*, 81*c* are attached may be altered, the pedestal parts 81*b*, 81*c* are provided below the forward slanted surface parts 81*g*, 81*g* and the horizontal upper bottom surface parts 81*h*. 81*i*.

Sound waves outputted from the speaker units provided at the mount positions 85, 86 are radiated being forward spread more or less at the centers thereof, from one or more of sound radiation holes formed in the front slanted surface parts 81*f*, 81*g* and through acoustic paths passing through gaps between the horizontal upper bottom surface parts 81*h*, 81*i* and the surface of a table. Thus, the speaker units 93 are accommodated being slanted forward from the vertical direction, as viewed in the direction of the center axes 93*d* of their front opening parts.

In the figure, the rear slanted part 81*j* of the lower case are formed therein with a plurality of air holes 81*k*, 81l in the second zones in which the speaker units are accommodated in the direction of key arrangement and as well in the vicinity of the second zones. The number and size of these air holes may be designed so as to serve also as sound radiation holes.

In the figure, there are shown a connecting terminal part 81*m* (including, for example, a headphone terminal and a microphone terminal) provided in the front surface of the lower case, a terminal connecting part 81*n* (including, for example, power source adapter terminals, connecting terminals for an external computer) provided in the rear surface of the lower case, connecting terminal part 81*o* (including, for example, connection terminals for an external sustain switch, a MIDI input terminals and MIDI output terminals) provided in the rear surface of the lower case, and a cover 81*p* for the battery case provided in the vicinity of the center of the horizontal bottom surface part 81*a*.

In the figure, there are shown an analog circuit board 87, a digital circuit board 88, a jack (external connecting terminal) circuit board, which are accommodated in a zone indicated by a broken line. These electric circuit board parts are accommodated in a space between the pivot lower limit position of the inertia generating part (92*d* in FIG., 8) for the inertia body (92 in FIG. 8) and the bottom plate of the lower case 81 within the electronic keyboard instrument, being arranged on the bottom plate of the lower case in the direction of key arrangement, with respect to the speaker units.

The analog circuit board 87 is mounted thereon with an amplifier circuit, and the digital circuit board 88 is mounted thereon with a music signal generating part (sound source) and a control CPU while the jack (for external connecting terminals) circuit board 89 is mounted thereon with an I/O interface circuit and relay terminals.

The bottom plate of the lower case 81 in the zone where the electric circuit parts, as stated above, are located is a horizontal bottom surface part 81 which is located at the lowermost position of the lower case 81, except the pedestal parts 81*a* to 81*d*. On the contrary, in the embodiment which has been explained with reference to FIG. 6, the electric circuit part 73 is attached to the bottom plate of the front surface portion 71*f*, similar to the speaker units 16.

Figure 8:
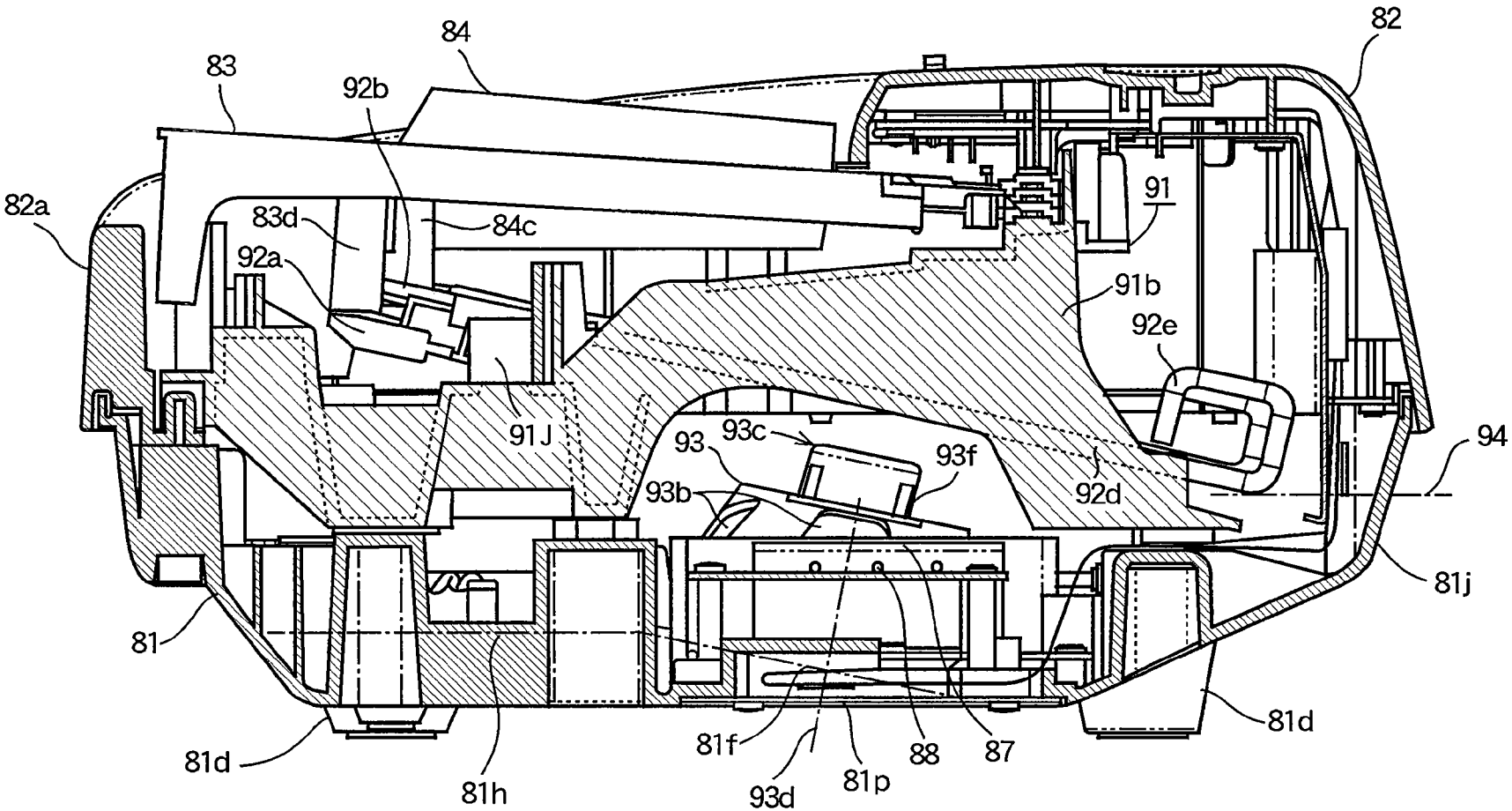
FIG. 8 is a sectional view of the sixth embodiment taken along line A indicated in FIG. 7(*b*).

Accordingly, the embodiment shown in FIGS. 7 and 8 may have a large volume for accommodating the electric circuit parts, and enables the electric circuit parts to be horizontally attached.

FIG. 8 is a longitudinal sectional view illustrating the electronic keyboard instrument in the sixth embodiment which has been explained with reference to FIG. 7, as viewed in the direction of arrows A-A shown in FIG. 7(*b*). In the figure, like reference numerals are used to denote like parts to those shown in FIG. 7.

Since this electronic circuit board has a structure similar to that in the fifth embodiment shown in FIG. 6, except the structure of the lower case and the speaker units, the explanation to the detailed structure thereof will be omitted. Alphabetical subscripts correspond to the subscripts used in FIG. 6. Further, the switch substrate 7 and the key switch 8, the lower limit stopper 18, the upper limit stopper 19, the lower limit stopper 17, the fastening screws 6, 13 to 16 and the like are not shown in this figure.

The keyboard comprises a plurality of keys including, for example, key body parts (white keys) 83 and key body parts (black keys) 84 a part of which is show in the figure. These keys are pivotably supported on a keyboard frame (support member) 91.

The keyboard frame 1 has such a structure that a planar member extended in the direction of key arrangement is reinforced by several ribs (longitudinal wall ribs) including, for example, ribs 91*b*.

Among these ribs, the ribs 91*b* are provided for coupling the rear lower member, the upper member and the front lower member. The ribs 91 are provided respectively in gaps defined between a plurality of adjacent mass bodies 92, for example, gaps between adjacent keys. Thus, the ribs (longitudinal wall ribs) 91*b* are extended downward from the upper member extended in the direction of key arrangement, through the gaps between the several mass bodies 92.

The mass bodies 92 are provided respectively to the several keys, and are arranged in the direction of key arrangement, being pivotably supported.

Each of the mass bodies 92 has a pivot fulcrum part supported on a mass body pivot support part 91J, a main driven part 92*a* and a sub driven part 92*b* which are engaged with a force transmitting part 83*d* for the key body part (white key) in front of the pivot fulcrum part, and an arm-like inertia generating part 92*d* for generating an inertia moment in rear of the pivot fulcrum part, and also has a mass concentration part 92*e* in rear of the pivot fulcrum part. The main driven part 92*a* and the sub driven part 92*b* are engaged with the force transmitting part 83*d*.

The rear side surface of the force transmitting part 83*d* for the key body part (white key) 83 is substantially coincident with the front surface of the forward end part of the key body part (black key) 84 in the longitudinal direction of the key. Meanwhile, a force transmitting part 84*c* for the key body part (black key) 84 has a similar bottom plate and a felt at a position where it overlaps with the bottom plate of the force transmitting part 83*d* for the white key.

The key body part (back key) 84 is also provided thereto with a similar mass body part which is pivotally supported by the mass body pivot support part and which is adapted to be pivoted by an associated force transmitting part 84*c* for the black key.

The mass body pivot supporting part 91J is set in such a way that the position of the pivot fulcrum part becomes higher than the lowest decent position of the inertia generating part 92*d* when the inertia generating part 92*d* is located at the pivot lower limit position (as shown in the figure).

There are shown a speaker unit 93, a rear opening part 93*b*, the uppermost part (upper edge of a magnetic circuit part 93*f*) 93*c* of the speaker unit, the center axis 93*d* of the front opening part and a magnetic circuit part 93*f*.

The speaker unit 93 is accommodated in a lower space between the several mass bodies 92 provided for the respective keys below the keyboard, and the bottom surface of the lower case 81, outside the pivoting range of the inertia generating part 92*d*.

The pivot lower limit position (as shown in the FIGURE) of the inertia generating part 92*d* is inclined rearward and extended downward. The speaker unit 93 is located in a space below the inertia generating part 92*d*, and is accommodated in such a way that the uppermost part 93*c* of the speaker unit is higher than the lowest descent position 94 of the inertia generating part 92*d*.

In a place where the rib 91*b* is present, the height of the uppermost part 93*c* of the speaker unit 93 is limited by the lower edge of the rib 91*b*. Thus, when the inertia generating part 92*d* is located at its pivot lower limit position (as shown in the FIGURE), the lower surface of the inertia generating part 92*d* is preferably made to be coincident with a part of the lower edge of the rib 91*b*. More preferably, the lower edge of the rib 91*b* is curved (so as to be upward convex) in order to utilize at maximum the space blow the pivot lower limit position of the inertia generating part 92*d*, thereby it is possible to accommodate and position, for example, a speaker having an opening diameter larger that that of the speaker unit 93 as shown. Further, on the contrary, the lower case 81 may be shallower in order to restrain the height of the electronic keyboard instrument.

Similar to the embodiment which has been explained with reference to FIGS. 2 and 3, the speaker unit 93 may be accommodated between adjacent ribs (longitudinal wall ribs) 91*b* which are formed at positions where the white keys are adjacent to one another in the direction of key arrangement. Thus, the placement of the speaker unit 93 may be prevented from being hindered by the presence of the ribs 91*b*, thereby it is possible to increase the opening diameter of the speaker unit 93 or to restrain the height of the electronic keyboard instrument.

Even in this embodiment, the speaker unit 93 may be accommodated only by replacing an existing keyboard frame with the keyboard frame without improving the existing keyboard frame 91 and upper case 82.

Since the horizontal bottom surface part 81*a* is higher than the lower ends of the pedestal parts 81*b* to 81*e*, the lower case 81 may be stably set on a table or the like, and further, sound waves from the speaker unit 93 may be prevented from being propagated, direct to the table or the like through the intermediary of the horizontal bottom surface part 81*a*.

In this embodiment, a main acoustic path is formed so as to extend from the front opening part (which is not shown) of the speaker unit 93 through the plurality of sound radiation holes formed in the forward slanted surface parts 81*f*, 81*g*, and is defined between the horizontal upper bottom surface part 81*h* and the surface of the table.

In the case of externally radiating sound waves from the plurality of rear opening parts 93*b* formed in the speaker unit 93, the sound wave may be externally radiated through the intermediary of an acoustic path the same as the second acoustic path 77 which has been explained with reference to FIG. 6. This second acoustic path is extended from the rear opening parts 93*b* to the outside through the gaps between the plurality of the mass bodies 92 and the keyboard frame 91, the gaps between several keys such as the key bodies (white keys) 83 and the key bodies (black keys) 84.

Meanwhile, as explained with reference to FIG. 7, sound waves from the rear opening parts 93*b* may be radiated through the plurality of air holes 81*k*, 81*l* formed in the rearward slanted part 81*j* of the lower case. Further, the sound radiation holes are formed in the rear upper part of the upper case 82.

In the fifth embodiment which has been explained with reference to FIG. 6 and the sixth embodiment which has been explained with reference to FIGS. 7 and 8, the speaker units are arranged in the electronic keyboard instrument having mass bodies. However, these speaker units may be also arranged in an electronic keyboard instrument having no mass bodies, as in the fourth embodiment shown in FIG. 5.

What is claimed is:

1. An electronic keyboard instrument comprising:

a frame member;

a keyboard which has a plurality of keys pivotably supported by the frame member;

a lower case which is formed integrally with or separately from the frame member under the keyboard; and an electroacoustic transducer which is accommodated in a space between the keyboard and a bottom plate of the lower case, and which outputs an acoustic wave, wherein a lowermost portion of the electroacoustic transducer is mounted on a surface of a lowermost portion of the frame member or the lower case, and a lowermost portion of the keyboard is positioned above the lowermost portion of the electroacoustic transducer, wherein the acoustic wave outputted from the electroacoustic transducer is radiated outwardly through sound passages configured as gaps in the frame member and gaps between the plurality of the keys, and wherein the electroacoustic transducer is accommodated in the space such that a central axis of a front opening part of the electroacoustic transducer is inclined in a rear direction opposite of a front direction directed to a front end of the keys from a vertically up direction of the keyboard.

2. An electronic keyboard instrument comprising:

a frame member;

a keyboard which has a plurality of keys pivotably supported by the frame member;

a lower case which is formed integrally with or separately from the frame member under the keyboard; and an electroacoustic transducer which is accommodated in a space between the keyboard and a bottom plate of the lower case, and which outputs an acoustic wave, wherein a lowermost portion of the electroacoustic transducer is mounted on a surface of a lowermost portion of the frame member or the lower case, and a lowermost portion of the keyboard is positioned above the lowermost portion of the electroacoustic transducer, wherein the acoustic wave outputted from the electroacoustic transducer is radiated outwardly through sound passages configured as gaps in the frame member and gaps between the plurality of the keys, wherein the frame member is formed with an upper section which extends along a width direction of the key board which is perpendicular to a depth direction of the keyboard, and partition ribs which extend downward from the upper section into the space between the lower case and the keyboard for reinforcing the frame member, and which are disposed between groups of white keys of the keyboard, and wherein the electroacoustic transducer is disposed between adjacent ones of the partition ribs within the space.

3. An electronic keyboard instrument comprising:

a frame member which has a plurality of mass supporting parts;

a keyboard which has a plurality of keys pivotably supported by the frame member and a plurality of force transmission parts mounted to the respective keys;

a plurality of mass bodies which are respectively disposed below corresponding ones of the keys and which are pivotably supported by corresponding ones of the mass supporting parts, so that the mass bodies pivot by the force transmission parts mounted to the corresponding keys;

a lower case which is formed integrally with or separately from the frame member under the plurality of the mass bodies; and an electroacoustic transducer which is accommodated in a space between the mass bodies and a bottom plate of the lower case, and which outputs an acoustic wave, wherein the space is defined between the force transmission parts and the rear end portions of the keys, the force transmission parts located forward from the rear end portions of the keys, and wherein the acoustic wave outputted from the electroacoustic transducer is radiated outwardly through sound passages configured as gaps between the plurality of the mass bodies and gaps in the frame member.

4. The electronic keyboard instrument according to claim 3, wherein the plurality of the mass bodies have pivot point parts which are supported by the corresponding mass supporting parts, operation parts which contact to the force transmission parts of the corresponding keys at positions towards the front end of the keys with respect to the pivot point parts, and inertia generating parts which generate a moment of inertia at positions towards the rear end of the keys with respect to the pivot point parts, wherein the mass supporting parts are mounted such that the pivot point part of each mass body is positioned higher than a lowermost descending position of the inertia generating part when the inertia generating part of each mass body pivots to a lower limit position, and wherein the electroacoustic transducer is accommodated in the space below the inertia generating parts of the mass bodies such that an uppermost portion of the electroacoustic transducer is positioned higher than the lowermost descending position of each inertia generating part.

5. The electronic keyboard instrument according to claim 3, further comprising an upper case which is coupled to the lower case and covers a rear portion of the keyboard, wherein the upper case is provided with one or more sound emitting holes on at least a rear portion of the upper case, such that the acoustic wave outputted from the electroacoustic transducer is radiated outwardly through sound passages configured as the sound emitting holes of the upper case.

6. The electronic keyboard instrument according to claim 3, wherein at least one of the lower case and the frame member is provided with one or more sound emitting holes on front lower portions thereof, so that the acoustic wave outputted from the electroacoustic transducer is radiated outwardly through sound passages configured as the sound emitting holes.

7. The electronic keyboard instrument according to claim 6, wherein the lower case is provided with a pedestal part and a concave part at a bottom surface portion of the lower case, wherein the concave part is formed downward from the bottom surface portion of the lower case, and accommodates a portion of the electroacoustic transducer, and wherein the sound emitting holes are provided on at least a front portion of the concave part of the lower case.

8. The electronic keyboard instrument according to claim 3, wherein the electroacoustic transducer is accommodated in the space such that a central axis of a front opening part of the electroacoustic transducer is inclined towards the rear end of the keys from a vertically up direction of the keyboard.

9. The electronic keyboard instrument according to claim 3, wherein the frame member is formed with an upper section which extends along a width direction of the key board which is perpendicular to a depth direction of the keyboard, and partition ribs which extend downward from the upper section into the space between the lower case and the keyboard for reinforcing the frame member, and which are disposed between groups of white keys of the keyboard, and wherein the electroacoustic transducer is disposed between adjacent ones of the partition ribs within the space.

10. The electronic keyboard instrument according to claim 3, further comprising an electric circuit part which is disposed in the space in alignment with the electroacoustic transducer along a width direction of the keyboard which is perpendicular to a depth direction of the keyboard for driving the electroacoustic transducer.

11. The electronic keyboard instrument according to claim 3, wherein a central axis of a front opening part of the electroacoustic transducer is inclined in a direction towards the front end of the keys from a vertically down direction of the keyboard, and wherein at least one of the lower case and the frame member is provided with one or more sound emitting holes on front lower portions thereof, so that the acoustic wave outputted from the electroacoustic transducer is radiated outwardly through sound passages configured as the sound emitting holes.

12. An electronic keyboard instrument comprising:

a key frame member;

a keyboard which has a plurality of keys pivotably supported by the key frame member;

a lower case which is formed integrally with or separately from the key frame member under the keyboard; and an electroacoustic transducer which outputs an acoustic wave, and which is accommodated below the keyboard or the key support member and above an upper face of the lower case such that a central axis of a front opening part of the electroacoustic transducer is inclined in a direction towards the front end of the keys from a vertically down direction of the keyboard, wherein at least one of the lower case and the key frame member is provided with one or more sound emitting holes which are formed on lower portions of the at least one of the lower case and the key frame member and which are directed in a direction towards the front end of the keys, so that the acoustic wave outputted from the electroacoustic transducer is radiated outwardly through sound passages configured as the sound emitting holes.

13. The electronic keyboard instrument according to claim 12, wherein the lower case is provided with a pedestal part and a concave part at a bottom surface portion of the lower case, wherein the concave part is formed downward from the bottom surface portion of the lower case, and accommodates a portion of the electroacoustic transducer, and wherein the sound emitting holes are provided on at least a front portion of the concave part of the lower case.

14. The electronic keyboard instrument according to claim 12, wherein the lower case is divided into a first region and a second region along a width direction of the keyboard which is perpendicular to a depth direction of the keyboard, so that the electroacoustic transducer is not disposed in the first region but disposed in the second region, wherein the bottom surface portion of the lower case is shaped in a flat face in the first region, and shaped in a slant face in the second region such that the slant face is inclined in a direction towards the front end of the keys and positioned higher than the flat face, wherein the electroacoustic transducer is mounted on the slant face made of a bottom plate of the lower case, wherein a plurality of pedestals are provided on the lower case and at least one of the pedestals is provided under the flat face of the bottom surface portion of the lower case in the first region, and wherein the sound emitting holes are provided on the slant face of the bottom surface portion of the lower case.

15. The electronic keyboard instrument according claim 12, wherein the frame member is formed with an upper section which extends along a width direction of the key board which is perpendicular to a depth direction of the keyboard, and partition ribs which extend downward from the upper section into the space between the lower case and the keyboard for reinforcing the frame member, and which are disposed between groups of white keys of the keyboard, and wherein the electroacoustic transducer is disposed between adjacent ones of the partition ribs within the space.

16. The electronic keyboard instrument according to claim 12, further comprising an electric circuit part which is disposed in the space in alignment with the electroacoustic transducer along a width direction of the keyboard which is perpendicular to a depth direction of the keyboard for driving the electroacoustic transducer.

* * * * *